US007932005B2

(12) United States Patent
Ohira et al.

(10) Patent No.: US 7,932,005 B2
(45) Date of Patent: Apr. 26, 2011

(54) NEGATIVELY-CHARGEABLE ELECTROPHOTOGRAPHIC PHOTOSENSITIVE MEMBER, IMAGE FORMING PROCESS AND ELECTROPHOTOGRAPHIC APPARATUS

(75) Inventors: Jun Ohira, Suntou-gun (JP); Makoto Aoki, Yokohama (JP); Kazuto Hosoi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/683,710

(22) Filed: Jan. 7, 2010

(65) Prior Publication Data

US 2010/0112470 A1 May 6, 2010

Related U.S. Application Data

(63) Continuation of application No. PCT/JP2009/059110, filed on May 12, 2009.

(30) Foreign Application Priority Data

May 21, 2008 (JP) ..... 2008-133042

(51) Int. Cl.
*G03G 5/08* (2006.01)

(52) U.S. Cl. ..... 430/65; 430/60; 399/159

(58) Field of Classification Search ..... 430/65, 430/60; 399/159
See application file for complete search history.

(56) References Cited

U.S. PATENT DOCUMENTS

| | | | | |
|---|---|---|---|---|
| 4,443,529 | A | 4/1984 | Kanbe et al. | 430/65 |
| 4,642,279 | A * | 2/1987 | Tanigami et al. | 430/66 |
| 4,904,556 | A * | 2/1990 | Amada et al. | 430/31 |
| 5,556,729 | A * | 9/1996 | Fukuda et al. | 430/65 |
| 5,849,446 | A | 12/1998 | Hashizume et al. | |
| 5,976,745 | A | 11/1999 | Aoki et al. | |
| 6,183,930 | B1 | 2/2001 | Ueda et al. | |
| 6,238,832 | B1 | 5/2001 | Hashizume et al. | |
| 6,322,943 | B1 | 11/2001 | Aoki et al. | |
| 6,753,123 | B2 | 6/2004 | Okamura et al. | |
| 6,846,600 | B2 | 1/2005 | Ehara et al. | |
| 6,947,688 | B2 * | 9/2005 | Inoue et al. | 399/174 |
| 6,991,879 | B2 | 1/2006 | Hosoi et al. | |
| 7,033,721 | B2 | 4/2006 | Hashizume et al. | |
| 7,157,197 | B2 | 1/2007 | Aoki et al. | |
| 7,255,969 | B2 | 8/2007 | Kojima et al. | |
| 2007/0059618 | A1 | 3/2007 | Kurimoto et al. | 430/58.5 |

FOREIGN PATENT DOCUMENTS

| | | |
|---|---|---|
| JP | 57-177156 | 10/1982 |
| JP | 61-262745 | 11/1986 |
| JP | 63-013051 | 1/1988 |
| JP | 63-125942 | 5/1988 |
| JP | 08-137119 | 5/1996 |
| JP | 2002-236379 | 8/2002 |
| JP | 2007-108650 | 4/2007 |

OTHER PUBLICATIONS

Diamond, A.S., ed., et al., Handbook of Imaging Materials, Second edition, Marcel Dekker, Inc., NY (2002), pp. 146-148.*

International Search Report and Written Opinion in related corresponding PCT International Application No. PCT/JP2009/059110, mailed on Jun. 30, 2009.

* cited by examiner

*Primary Examiner* — Janis L Dote

(74) *Attorney, Agent, or Firm* — Fitzpatrick, Cella, Harper & Scinto

(57) ABSTRACT

A negatively-chargeable electrophotographic photosensitive member, has, between a cylindrical substrate and a photoconductive layer, a first lower-part layer formed of a non-single crystal material containing silicon atoms and a second lower-part layer formed of a non-single crystal material containing silicon atoms, and on its photoconductive layer has an upper-part layer formed of a non-single crystal material containing silicon atoms. The first lower-part layer is a layer containing a periodic-table Group 13 element, and the upper-part layer has a region capable of retaining electrification charges.

11 Claims, 5 Drawing Sheets

NEGATIVELY-CHARGEABLE ELECTROPHOTOGRAPHIC PHOTOSENSITIVE MEMBER, IMAGE FORMING PROCESS AND ELECTROPHOTOGRAPHIC APPARATUS

This application is a continuation of International Application No. PCT/JP2009/059110, filed May 12, 2009, which claims the benefit of Japanese Patent Application No. 2008-133042, filed May 21, 2008.

BACKGROUND OF THE INVENTION

1. Field of the Invention

This invention relates to a negatively-chargeable electrophotographic photosensitive member which may less cause image defects during image formation and can maintain good image formation over a long period of time, an image forming process making use of the negatively-chargeable electrophotographic photosensitive member, and an electrophotographic apparatus having such a negatively-chargeable electrophotographic photosensitive member. The negatively-chargeable electrophotographic photosensitive member is hereinafter also expressed simply as "electrophotographic photosensitive member".

2. Description of the Related Art

Materials that form photoconductive layers in solid-state image pick-up devices, in electrophotographic photosensitive members in the field of image formation or in character readers are required to have properties as follows: They are highly sensitive and have a high SN ratio [photocurrent (Ip)/dark current (Id)]; have absorption spectral characteristics matched to spectral characteristics of electromagnetic waves to be radiated; have a high response to light and have the desired dark conductivity; and are harmless to human bodies when used.

Further, in the solid-state image pick-up devices, the materials are required to have properties that enable easy erasure of the afterimage in a prescribed time. In particular, in the case of electrophotographic photosensitive members of apparatus used as business machines in offices, the harmlessness in their use is an important point.

Materials that attract notice from such viewpoints include amorphous silicon (hereinafter also expressed as "a-Si") whose dangling bonds have been modified with monovalent elements such as hydrogen atoms or halogen atoms, and its application to electrophotographic photosensitive members has been made.

Such electrophotographic photosensitive members making use of a-Si commonly include those in which an a-Si layer is formed on a conductive substrate (hereinafter also expressed as "a-Si photosensitive member"). As processes by which the a-Si layer is formed on the substrate, processes such as sputtering; thermal CVD, in which source gases are decomposed by heat; photo-assisted CVD, in which source gases are decomposed by light; and plasma-assisted CVD, in which source gases are decomposed by plasma are known in the art.

Of these, the plasma-assisted CVD (chemical vapor deposition), in which source gases are decomposed by direct-current or high-frequency or microwave glow discharge to form films on the substrate, has been put into practical use in a very advanced state in the production of electrophotographic photosensitive members.

Japanese Patent Application Laid-open No. 2002-236379 discloses a make-up in which, as layer configuration of an electrophotographic photosensitive member, a photoconductive layer composed chiefly of a-Si and containing a modification element added appropriately, and, in addition thereto, further provided on the surface side of the electrophotographic photosensitive member, an upper-part blocking layer having a blocking ability and a surface protective layer are deposited in layers.

The above Japanese Patent Application Laid-open No. 2002-236379 also discloses an electrophotographic photosensitive member provided between the photoconductive layer and the surface protective layer with an upper-part blocking layer which is provided with a region changing in content ratio of silicon atoms and carbon atoms and also containing a periodic-table Group 13 element in a prescribed state of distribution.

In addition, Japanese Patent Application Laid-open No. S57-177156 discloses a layer configuration in which a barrier layer provided between a substrate and a photoconductive layer for the purpose of reducing dark attenuation and residual potential is formed in a double layer.

The barrier layer formed in a double layer as disclosed in Japanese Patent Application Laid-open No. S57-177156 has layer configuration consisting of, from the substrate side;

a conductivity control type first barrier layer to which a periodic-table Group 13 element or a periodic-table Group 15 element has been added in the case of a positive-charging electrophotographic photosensitive member or in the case of a negatively-chargeable electrophotographic photosensitive member, respectively; and an electrically insulating type second barrier layer composed chiefly of silicon atoms and containing at least one kind of atoms selected from carbon atoms, nitrogen atoms and oxygen atoms.

Japanese Patent Application Laid-open No. H08-137119 also discloses an electrophotographic apparatus which has an a-Si photosensitive member, a developer having a toner with a small particle diameter and a two-component brush developing means in combination.

The electrophotographic apparatus disclosed in Japanese Patent Application Laid-open No. H08-137119 is an electrophotographic apparatus having; as the developer, a toner is used which is 1) 4.5 to 9.0 μm in weight average particle diameter and 2) 10 to 50 μC/g in triboelectric charge quantity; and as the electrophotographic photosensitive member, one at least being 5 or less in average of dielectric constants up to 1 μm in depth from the surface of the electrophotographic photosensitive member and/or having, in the range of 0.1 to 2 μm in depth from that surface, a region where an average of dielectric constants is 5 or less.

SUMMARY OF THE INVENTION

Such conventional electrophotographic photosensitive members have enabled us to obtain electrophotographic photosensitive members having practical performance and obtain image forming processes and electrophotographic apparatus which can achieve practical resolution.

However, in recent years, electrophotographic apparatus such as copying machines and printers have advanced in digital processing, full-color image formation and high-speed processing. Under such circumstances, making the most of characteristics of being unnecessary for platemaking and machine plating which are necessary for offset printing, electrophotographic systems have become expected to compete in the market of light printing where printing may be performed only in necessary quantity on demand. Accordingly, it is sought to provide an electrophotographic photosensitive member, an image forming process and an electrophotographic apparatus which promise much higher quality than ever. Then, in order to materialize images having higher quality, an image forming process making use of an exposure method of exposing image areas to light [an imagewise exposure method (IAE method)] and an image forming process making use of a two-component developing system which performs development while a two-component development type developer containing a toner and magnetic particles is kept in contact with an electrophotographic photosensitive member have been proposed and put into practical use.

However, where images are formed in combination of such a two-component developing system with the negatively-chargeable electrophotographic photosensitive member having conventional layer configuration as disclosed in Japanese Patent Applications Laid-open No. 2002-236379 and No. 57-177156, it has come about in some cases that pinholes due to insulation breakdown occur in the electrophotographic photosensitive member when formed under development conditions that can satisfy such a high image quality as that required in the market of light printing. The reason therefor is that, in the case of the above combination of the two-component developing system with the negatively-chargeable electrophotographic photosensitive member, it tends to bring about a phenomenon that electric charges concentrate locally on the electrophotographic photosensitive member to make the pinholes due to insulation breakdown occur in the electrophotographic photosensitive member, as so considered. This phenomenon has made it difficult to use the negatively-chargeable electrophotographic photosensitive member under development conditions that can satisfy the image quality desired.

Accordingly, it is desired to provide a negatively-chargeable electrophotographic photosensitive member which is free of any increase in residual potential and in which any pinholes due to insulation breakdown do not occur even under two-component development conditions that can satisfy such a high image quality as that required in the market of light printing, and an image forming process and an electrophotographic apparatus which make use of the same.

That is, the present invention is a negatively-chargeable electrophotographic photosensitive member which has a cylindrical substrate having a conductive surface and provided thereon a photoconductive layer formed of a non-single crystal material containing silicon atoms, wherein;

a first lower-part layer formed of a non-single crystal material containing silicon atoms and a second lower-part layer formed of a non-single crystal material containing silicon atoms are provided between the cylindrical substrate and the photoconductive layer, and an upper-part layer formed of a non-single crystal material containing silicon atoms is provided on the photoconductive layer; the first lower-part layer being a layer containing an element belonging to Group 13 of the periodic table, and the upper-part layer having a region capable of retaining electrification charges.

The present invention is also an image forming process which has a charging step of charging the surface of a negatively-chargeable electrophotographic photosensitive member electrostatically; a latent image forming step of forming an electrostatic latent image on the surface of the negatively-chargeable electrophotographic photosensitive member, thus charged; a developing step of moving a toner held on a developer carrying member, to the surface of the negatively-chargeable electrophotographic photosensitive member to develop the electrostatic latent image to form a toner image on the surface of the same; a transfer step of transferring the toner image from the surface of the negatively-chargeable electrophotographic photosensitive member to a transfer material; and a cleaning step of removing from the negatively-chargeable electrophotographic photosensitive member a transfer residual toner having remained on the surface of the negatively-chargeable electrophotographic photosensitive member; wherein the negatively-chargeable electrophotographic photosensitive member is the above negatively-chargeable electrophotographic photosensitive member.

The present invention is still also an electrophotographic apparatus which has a charging means for charging the surface of a negatively-chargeable electrophotographic photosensitive member electrostatically; a latent image forming means for forming an electrostatic latent image on the surface of the negatively-chargeable electrophotographic photosensitive member, thus charged; a developing means for moving a toner held on a developer carrying member, to the surface of the negatively-chargeable electrophotographic photosensitive member to develop the electrostatic latent image to form a toner image on the surface of the same; a transfer means for transferring the toner image from the surface of the negatively-chargeable electrophotographic photosensitive member to a transfer material; and a cleaning means for removing from the negatively-chargeable electrophotographic photosensitive member a transfer residual toner having remained on the surface of the negatively-chargeable electrophotographic photosensitive member; wherein the negatively-chargeable electrophotographic photosensitive member is the above negatively-chargeable electrophotographic photosensitive member.

The negatively-chargeable electrophotographic photosensitive member of the present invention can not easily cause any increase in residual potential and any pinholes due to insulation breakdown, even in its use in combination with the two-component developing system, and can provide high-resolution images stably over a long period of time.

Further features of the present invention will become apparent from the following description of exemplary embodiments with reference to the attached drawings.

DESCRIPTION OF THE EMBODIMENTS

As a result of many extensive studies, the present inventors have discovered that the above problems can be resolved by forming a lower-part blocking layer in a multi-layer structure in which a first lower-part layer having a blocking ability against electrons and a second lower-part layer having a blocking ability against holes are layered in this order.

They have discovered that forming the lower-part blocking layer in such a multi-layer structure enables stable reproduction of images with a high image quality without adversely affecting the controlling of residual potential, satisfying the high image quality that is required in the market of light printing, and without causing any pinholes due to insulation breakdown.

More specifically, in the developing method making use of the two-component developing system in which a two-component development type developer is used, the two-component development type developer, which is held on a developer carrying member a two-component developing assembly has, is transported to a developing zone facing electrostatic latent images formed on the surface of the electrophotographic photosensitive member, where the rise of ears of the two-component developer is brought into contact with or proximity to the surface of the electrophotographic photosensitive member. Then, only the toner is moved to the surface of the electrophotographic photosensitive member by the aid of a stated development bias applied across the developer carrying member and the electrophotographic photosensitive member, whereby the electrostatic latent images are developed. Also, the two-component developer is commonly a developer in which magnetic particles (a carrier) having particle diameters of approximately from 5 μm or more to 100 μm or less and a toner having particle diameters of approximately from 1 μm or more to 10 μm or less are blended in a stated blending ratio.

Figure 8:
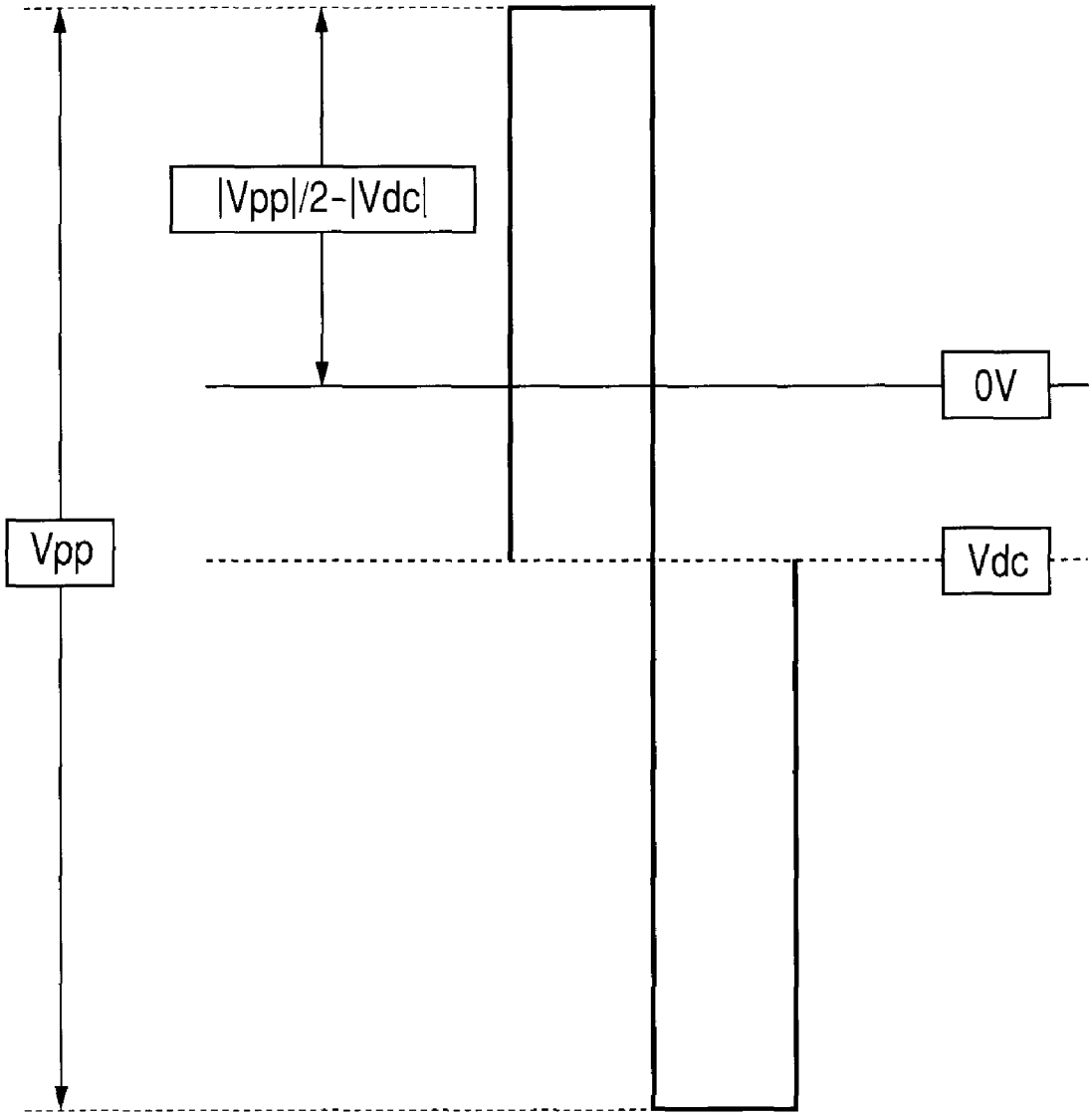
FIG. 8 is a diagrammatic chart showing a development bias in two-component development, used in the present invention.

In this case, as the development bias to be applied across the developer carrying member and the electrophotographic photosensitive member, it is common to use a voltage formed by superimposing a DC voltage and an AC voltage. In the case of the negatively-chargeable electrophotographic photosensitive member, a voltage is used in which, as shown in FIG. 8, an AC voltage that is a peak-to-peak voltage Vpp between the positive and negative sides is superimposed on a negative DC voltage Vdc.

Here, if the value of Vdc that is the value of the DC voltage and the value of Vpp that is the value of the peak-to-peak voltage between the positive and negative sides of the AC voltage are set small, the electric field applied from the developer carrying member to the developer is weak. Hence, the force to separate the toner from the carrier may inevitably decrease, resulting in a low developing performance. Accordingly, these values must be set high to certain degrees in order to form images in the high image quality that is required in the market of light printing.

Figure 3:
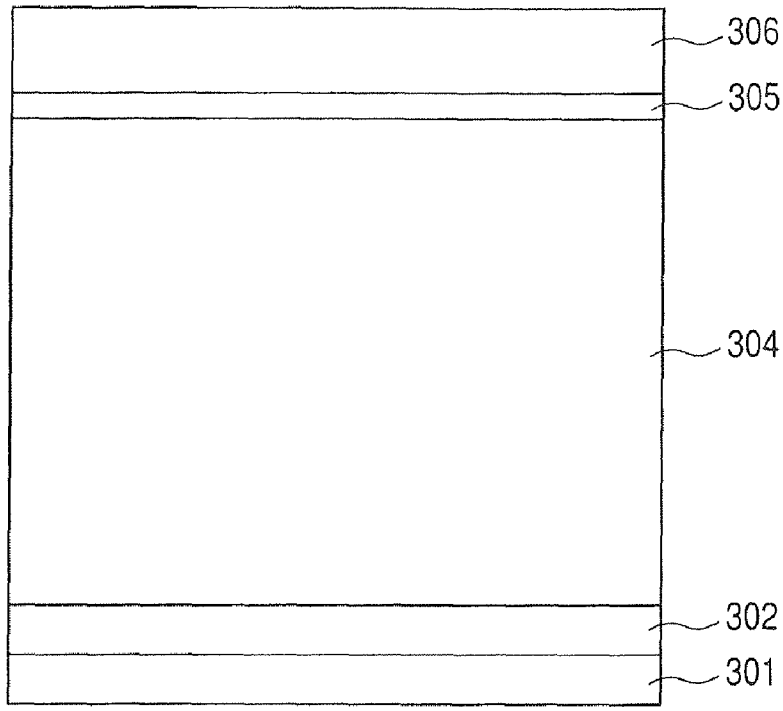
FIG. 3 (PRIOR ART)
FIG. 3 is a diagrammatic sectional view showing an example of layer configuration of a conventional negatively-chargeable electrophotographic photosensitive member.

In FIG. 3, a make-up of a negatively-chargeable electrophotographic photosensitive member is shown which has a conventional layer configuration having a cylindrical substrate having a conductive surface (hereinafter also expressed simply as "substrate") 301 and provided thereon a lower-part layer 302, a photoconductive layer 304, an upper-part blocking layer 305 and a surface protective layer 306. Where the negatively-chargeable electrophotographic photosensitive member having such a conventional layer configuration as shown in FIG. 3 is used, the electrophotographic photosensitive member may inevitably cause insulation breakdown when used in the range of Vdc and Vpp satisfying image formation in such a high image quality as that required in the market of light printing, to cause the pinholes in some cases. Such pinholes have caused faulty images.

As a result of many extensive studies made on the insulation breakdown of electrophotographic photosensitive member that may occur under such conditions, the present inventors consider that it occurs by the mechanism as explained below.

Where the relationship between Vpp and Vdc stated above is in a certain range or more, any inclusion of conductive foreign matter in the developing zone at which the developer carrying member provided in the two-component developing means faces the negatively-chargeable electrophotographic photosensitive member may bring about the phenomenon that electric charges concentrate locally on the electrophotographic photosensitive member through such foreign matter serving as a conductive path.

If this occurs, an electric field with a polarity reverse to the charging polarity may unwantedly come applied to the electrophotographic photosensitive member, so that, when, e.g., the electrophotographic photosensitive member is the one for negative charging, it comes about that electrons flood to the substrate side and holes to the surface side.

Usually, the lower-part layer of the negatively-chargeable electrophotographic photosensitive member is so designed for its conductivity type and dark conductivity as to block the holes that come to flow into the electrophotographic photosensitive member from its substrate side and to pass therethrough the electrons that are generated in the photoconductive layer and move to the substrate side. Hence, this brings about the phenomenon that electric charges concentrate locally on the electrophotographic photosensitive member, where the electrons coming from the substrate side flow into the electrophotographic photosensitive member when the electric field with a polarity reverse to the charging polarity is applied to the electrophotographic photosensitive member.

Then, the upper-part layer of the negatively-chargeable electrophotographic photosensitive member is usually made up of an upper-part blocking layer capable of retaining electrification charges and a surface protective layer which protects the surface of the electrophotographic photosensitive member. The upper-part blocking layer is so designed for its conductivity type and dark conductivity as to block the electrons that come to flow into the electrophotographic photosensitive member from its surface side and to pass therethrough the holes that are generated in the photoconductive layer and move to the surface side. Also, the surface protective layer is so designed for its dark conductivity, hardness and light transmission properties as to pass therethrough the electrons that come to flow into the electrophotographic photosensitive member from its surface side and to improve the electrophotographic photosensitive member in its scratch resistance and durability.

A surface protective layer having such composition that can satisfy the above properties often has a disposition that it blocks the holes unwantedly in its layer.

Hence, the phenomenon that electric charges concentrate locally on the electrophotographic photosensitive member occurs, and it comes about that the surface protective layer unwantedly blocks the holes that flood to the surface side when the electric field with a polarity reverse to the charging polarity is applied to the electrophotographic photosensitive member.

As the result of these, the interior of the electrophotographic photosensitive member comes into a state that the electrons having come to flow thereinto from its substrate side stay at a lower part of the upper-part blocking layer and the holes stay in the surface protective layer. That is, it comes into a state that a high electric field is formed in its region usually having a thickness of only about 1 μm, so that the insulation breakdown occurs, as so presumed.

In order to make such insulation breakdown not occur, it may be devised that the electrophotographic photosensitive member is so made up as not to allow such a high electric field to be formed in a region lying between the upper-part blocking layer, usually having a thickness of only about 1 μm, and the surface protective layer.

For that purpose, it may be devised that the surface protective layer is formed as a layer which can have both the property to pass therethrough the holes and the dark conductivity, hardness and light transmission properties that are feasible for practical use in usual processing, or to make the electrons less come to the lower part of the upper-part blocking layer.

In the former case, because of a surface protective layer positioned at the outermost surface of the electrophotographic photosensitive member, a match for other units making up the electrophotographic apparatus must be taken into account, and this narrows the freedom of selection.

In the latter case, in order to make the electrons less come to the lower part of the upper-part blocking layer, it may be devised to make the lower-part layer have a blocking ability against electrons. However, in usual processing, this may inevitably make the residual potential increase unless the electrons generated in the photoconductive layer can smoothly pass through that layer to the substrate side.

Accordingly, the present inventors have made many extensive studies on the latter case, i.e., on a make-up that makes the electrons less come to the lower part of the upper-part blocking layer. As the result, they have discovered that the problems can be resolved by forming the lower-part layer in such a double-layer structure that it is functionally so separated as to individually have a layer having a blocking ability chiefly against electrons and a layer having a blocking ability chiefly against holes.

As the result, they have discovered a negatively-chargeable electrophotographic photosensitive member which can be free of any increase in residual potential and may not cause any faulty images coming from pinholes due to insulation breakdown, even in combination of the negatively-chargeable electrophotographic photosensitive member with the two-component developing system, and can provide high-resolution images stably over a long period of time.

Thus, the first lower-part layer having a blocking ability chiefly against electrons is provided on the substrate side and the second lower-part layer having a blocking ability chiefly against holes is provided on the first lower-part layer, whereby, in usual processing, the holes having come to pass through the first lower-part layer can be blocked at the second lower-part layer. This can make the electrophotographic photosensitive member keep its charge characteristics.

In addition, the second lower-part layer passes therethrough the electrons generated in the photoconductive layer and the first lower-part layer passes therethrough the holes coming to flow thereinto from the substrate side, and hence carriers can re-combine with one another between the first lower-part layer and the second lower-part layer. This can prevent the residual potential from increasing. Then, where the phenomenon that electric charges concentrate locally on the electrophotographic photosensitive member has occurred and the electric field with a polarity reverse to the charging polarity has come applied to the electrophotographic photosensitive member, the first lower-part layer can block the electrons, and hence can make the electrons less come to the lower part of the upper-part blocking layer. As the result, this does not allow any high electric field to be formed in a region lying between the upper-part blocking layer and the surface protective layer, to keep the insulation breakdown from occurring, as so presumed.

Regarding the combination of a negatively-chargeable electrophotographic photosensitive member, an image forming process and an electrophotographic apparatus, the present inventors also have made extensive studies in order to materialize much higher image quality and running performance, by combining various electrophotographic processes with various electrophotographic photosensitive members.

They have made many studies on image forming processes and electrophotographic apparatus which make use of the negatively-chargeable electrophotographic photosensitive member of the present invention. As the result, it has turned out that a latent image forming step of forming electrostatic latent images on the surface of the negatively-chargeable electrophotographic photosensitive member is carried out by an imagewise exposure method (IAE method), in which the areas that correspond to image areas are exposed to light, and this can more sharply form the electrostatic latent images to be formed on the surface of the electrophotographic photosensitive member and is advantageous to the achievement of higher image quality. This IAE method has also been compared with another exposure method, a background exposure method (BAE method), in which non-image areas (background areas) are exposed to light. As the result, it has turned out that, in order to attain the like contrast in the both, the relationship found where the value of a peak-to-peak voltage between the positive and negative sides of an AC voltage applied to a developer carrying member is represented by Vpp and the value of a DC voltage applied to the same is represented by Vdc, i.e., the value of $|Vpp|/2-|Vdc|$, can be made small inasmuch as the IAE method is employed. It has also turned out that, as a result of this, the employment of the IAE method can provide conditions under which the insulation breakdown can not easily occur.

They have also discovered that, in the step of charging, a contact charging means having magnetic particles which are provided in contact with the electrophotographic photosensitive member may be used as a charging means and this brings an improvement in convergence of potential to make any potential non-uniformity not easily stand out. This is because the contact charging means having magnetic particles is of a voltage control system, as so presumed.

The present invention is described below with reference to the accompanying drawings.

Figure 1:
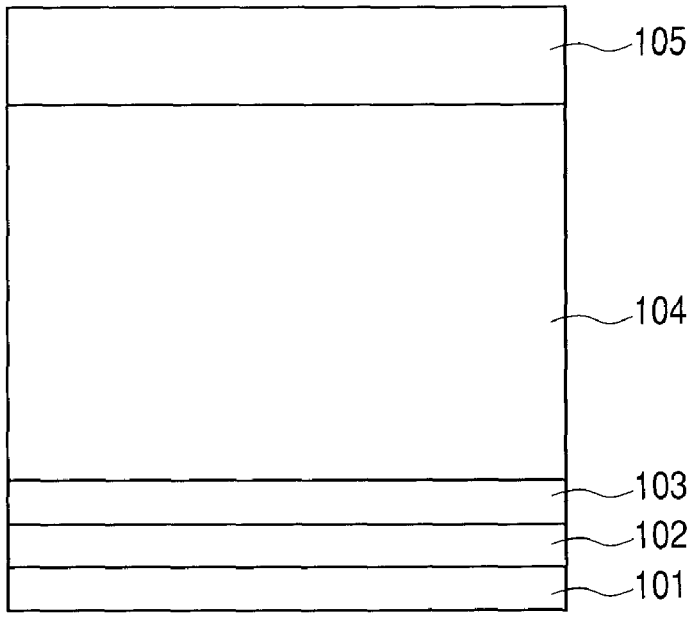
FIG. 1 is a diagrammatic sectional view showing an example of layer configuration of the negatively-chargeable electrophotographic photosensitive member of the present invention.

FIG. 1 shows as a diagrammatic view an example of the negatively-chargeable electrophotographic photosensitive member of the present invention.

The negatively-chargeable electrophotographic photosensitive member of the present invention has a cylindrical substrate 101 having a conductive surface 101, and formed (layered) thereon a first lower-part layer 102, a second lower-part layer 103, a photoconductive layer 104 and an upper-part layer 105 in this order. The photoconductive layer 104 is formed of a non-single crystal material containing silicon atoms. The first lower-part layer 102, which is formed of a non-single crystal material containing silicon atoms, and the second lower-part layer 103, which is formed of a non-single crystal material containing silicon atoms, are provided between the cylindrical substrate 101 and the photoconductive layer 104. Further, the upper-part layer, which is formed of a non-single crystal material containing silicon atoms, is provided on the photoconductive layer 104. The first lower-part layer 102 is also a layer containing a periodic-table Group 13 element (hereinafter also expressed simply as "Group 13 element"), and the upper-part layer 105 is a layer having a region capable of retaining electrification charges.

Inasmuch as the lower-part layer provided between the cylindrical substrate 101 and the photoconductive layer 104 is thus formed in a double-layer structure having the first lower-part layer 102 containing a Group 13 element and the second lower-part layer 103, this enables achievement of both the effect of keeping the residual potential from increasing during usual processing and the effect of keeping the pinholes due to insulation breakdown from occurring when the electric field with a polarity reverse to the charging polarity is applied to the electrophotographic photosensitive member.

In usual processing of negative charging, the lower-part layer is required to have the function to block the holes coming from the substrate side and pass therethrough the electrons coming from the photoconductive layer side. Inasmuch as it has such function, the dark attenuation and the residual potential can be kept controlled. However, as stated previously, in order to prevent the insulation breakdown that may occur because the electric field with a polarity reverse to the charging polarity is applied to the electrophotographic photosensitive member, it is necessary to block the electrons coming from the substrate side. This is performance which conflicts with the performance required in usual processing of negative charging. Hence, where the lower-part layer is made up of a single layer as having hitherto been so, an attempt to keep the insulation breakdown from occurring may inevitably bring about a relationship that does not satisfy the properties against dark attenuation and residual potential during usual processing, to make it very difficult to achieve the both at high levels.

Accordingly, in the present invention, the lower-part layer is so formed in double-layer structure as to have the second lower-part layer 103, which is to satisfy the performance required in usual processing, and the first lower-part layer, which is to prevent the insulation breakdown that may occur because the electric field with a polarity reverse to the charging polarity is applied to the electrophotographic photosensitive member. Its formation in such a double-layer structure has enabled high-level achievement of both the properties against dark attenuation and residual potential and the prevention of insulation breakdown.

In addition, a layer containing a Group 13 element is provided as the first lower-part layer 102 on the substrate side and the second lower-part layer 103 is provided on the first lower-part layer 102. As the result, the holes having moved through the first lower-part layer 102 from the cylindrical substrate 101 side to the photoconductive layer 104 side re-combine smoothly with the electrons having come to move through the second lower-part layer 103 from the photoconductive layer 104 side to the cylindrical substrate 101 side. Thus, the residual potential can be kept from coming about.

In the negatively-chargeable electrophotographic photosensitive member of the present invention, it is also preferable that the negatively-chargeable electrophotographic photosensitive member has surface potential in the range of from 5 V or more to 110 V or less after the negatively-chargeable electrophotographic photosensitive member is provided on its surface with positive electric charges of 2,000 $\mu C/m^2$ by using a positive-charging corona charging assembly and thereafter has been left to stand for 0.18 second. Controlling it within such a range of numerical value can achieve at higher levels both the effect of keeping the residual potential from increasing during usual processing and the effect of keeping the pinholes due to insulation breakdown from occurring when the electric field with a polarity reverse to the charging polarity is applied to the electrophotographic photosensitive member.

The above surface potential may also be in the range of from 40 V or more to 110 V or less. This is much preferable in order to achieve both the effect of keeping the residual potential from increasing during usual processing and the effect of keeping the pinholes due to insulation breakdown from occurring when the electric field with a polarity reverse to the charging polarity is applied to the electrophotographic photosensitive member.

The above surface potential is one found by measuring the surface potential of the negatively-chargeable electrophotographic photosensitive member after the negatively-chargeable electrophotographic photosensitive member is provided on its surface with positive electric charges of 2,000 $\mu C/m^2$ by using a measuring unit having a charging means and a destaticization exposure means and having a positive-charging corona charging assembly as the charging means and thereafter has been left to stand for 0.18 second.

Figure 4:
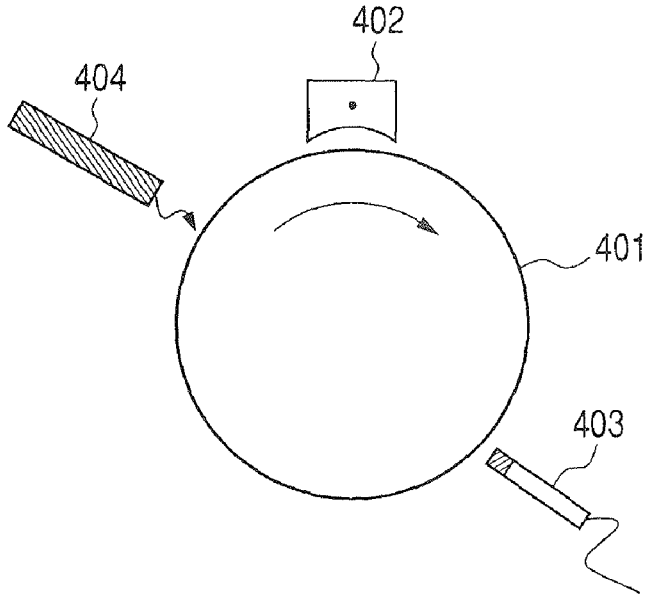
FIG. 4 is a diagrammatic sectional view of a chargeability measuring instrument used in the present invention.

Stated more specifically, it is measured with a chargeability measuring unit shown in FIG. 4. The chargeability measuring unit shown in FIG. 4 has a positive-charging corona charging assembly 402, a surface potentiometer 403 which measures the surface potential and an LED 404 for destaticization exposure which are clockwise provided in this order around a measuring object negatively-chargeable electrophotographic photosensitive member 401. The LED 404 for destaticization exposure is an LED having a wavelength of 660 nm and an exposure level of 4.2 $\mu J/cm^2$.

To make measurement, setting as 0 second the time at which the negatively-chargeable electrophotographic photosensitive member 401 is begun to be provided on its surface with positive electric charges by using the positive-charging corona charging assembly 402, its surface is provided with the positive electric charges in 0.12 second and then left to stand for 0.18 second, and thereafter the surface potential is measured. Thereafter, after 0.64 second, the surface is exposed to destaticization light, and thereafter, after 0.02 second, the electrophotographic photosensitive member 401 is provided with the positive electric charges. So as to repeat this process, the rotational speed of the negatively-chargeable electrophotographic photosensitive member 401 is controlled, to make measurement. The measuring unit is also so set up that the positive electric charges with which the negatively-chargeable electrophotographic photosensitive member 401 is provided on its surface can be changed in quantity by changing the value of electric current made to flow to the positive-charging corona charging assembly 402.

The cylindrical substrate 101 may be any desired one according to the driving system of the electrophotographic photosensitive member, and, e.g., may be a cylindrical substrate having a smooth surface or uneven surface. The cylindrical substrate may also have a thickness which is so determined appropriately as to obtain the desired electrophotographic photosensitive member. Where it is required to have flexibility as the electrophotographic photosensitive member, it may be as thin as possible as long as it can well exhibit the function as a substrate. However, in view of production and handling, and taking account of mechanical strength, the cylindrical substrate may preferably have a thickness of 0.5 mm or more.

As a material for the cylindrical substrate 101, a conductive material such as aluminum (Al) and stainless steel is commonly available. A substrate may also be used which is made of, e.g., a non-conductive material such as plastic, glass or ceramic and whose surface at least on the side where the photoconductive layer is to be formed has been provided with conductivity.

The conductive material may include, besides the foregoing, metals such as chromium (Cr), molybdenum (Mo), gold (Au), indium (In), niobium (Nb), tellurium (Te), vanadium (V), titanium (Ti), platinum (Pt), palladium (Pd) and iron (Fe), and alloys of any of these.

The plastic may include polyester, polyethylene, polycarbonate, cellulose acetate, polypropylene, polyvinyl chloride, polystyrene and polyamide.

The first lower-part layer 102 is formed on the cylindrical substrate 101.

As the first lower-part layer 102, in the present invention, it is made up of a non-single crystal material composed chiefly of silicon atoms and further containing a Group 13 element. It may also further contain hydrogen atoms and/or halogen atoms, and may also be incorporated with at least one selected from carbon atoms (C), nitrogen atoms (N) and oxygen atoms (O), so as to control stress and be made to have the function of improving adherence between the cylindrical substrate 101 and the second lower-part layer 103.

The first lower-part layer 102 may be formed by plasma-assisted CVD, sputtering or ion plating. The plasma-assisted CVD is preferred because films having especially high quality can be obtained. As a source material for feeding silicon atoms, a gaseous or gasifiable silicon hydride such as $SiH_4$, $Si_2H_6$, $Si_3H_8$ or $Si_4H_{10}$ may be used as a source gas, and may be decomposed by high-frequency power to form the layer. Further, in view of readiness in handling for layer formation and Si-feeding efficiency, the material may include $SiH_4$ and $Si_2H_6$ as preferred ones.

Here, the temperature of the cylindrical substrate 101 may preferably be kept at a temperature of from 200° C. to 450° C. in view of characteristics, and much preferably from 250° C. to 350° C. This is to accelerate the surface reaction at the surface of the cylindrical substrate 101 to effect structural relaxation sufficiently.

The internal pressure of the reactor may similarly appropriately be selected within an optimum range in accordance with layer designing. In usual cases, it may preferably be set at from $1\times10^{-2}$ Pa to $1\times10^{3}$ Pa, and much preferably from $5\times10^{-2}$ Pa to $5\times10^{2}$ Pa, and still much preferably from $1\times10^{-1}$ Pa to $1\times10^{2}$ Pa.

As discharge frequency used in plasma-assisted CVD in forming the first lower-part layer 102, any frequency may be used. More specifically, preferably usable is either of a high frequency of from 3 MHz or more to less than 30 MHz, which is called an HF band, and a high frequency of from 30 MHz or more to 300 MHz or less, which is called a VHF band.

The Group 13 element to be contained in the first lower-part layer 102 may specifically include boron (B), aluminum (Al), gallium (Ga), indium (In) and thallium (Tl). In particular, boron (B) is preferred. The source material for feeding boron atoms may include $BCl_3$, $BF_3$, $BBr_3$ and $B_2H_6$. $B_2H_6$ is preferred in view of readiness in handling. Thus incorporating the Group 13 element in the first lower-part layer 102 can pass therethrough the holes coming from the substrate side, to keep the residual potential from increasing during usual processing of negative charging, and can block the electrons coming from the substrate side when the electric field with a polarity reverse to the charging polarity is applied to the electrophotographic photosensitive member. As the result, this can bring the effect of keep the pinholes due to insulation breakdown from occurring.

The atoms of Group 13 element contained in the first lower-part layer 102 may also evenly uniformly be distributed in the first lower-part layer 102, or may be contained in such a state that they are distributed non-uniformly in the layer thickness direction. In either case, however, in the in-plane direction parallel to the surface of the substrate, such atoms may evenly be contained in a uniform distribution. This is preferable also in view of the achievement of uniform properties in the in-plane direction.

In any of these gases, a gas containing $H_2$ or halogen atoms may further be mixed in a desired quantity to form the layer. This is preferred in order to compensate unbonded arms of silicon atoms in the layer, and to improve layer quality, in particular, to improve charge retentivity. What is effective as source gases for feeding halogen atoms may include fluorine gas ($F_2$) and interhalogen compounds as exemplified by BrF, ClF, $ClF_3$, $BrF_3$, $BrF_5$, $IF_5$ and $IF_7$. It may also include silicon compounds containing halogen atoms, what is called silane derivatives substituted with halogen atoms, specifically including, e.g., silicon fluorides such as SiF4 and $Si_2F_6$, as preferred ones.

Any of these source gases for feeding silicon atoms may also optionally be diluted with a gas such as $H_2$, He, Ar or Ne when used.

Between the layer thickness of the first lower-part layer 102 and the content of the Group 13 element contained in the first lower-part layer 102, there may be the following relationship:

The layer thickness of the first lower-part layer 102 is from 0.1 μm or more to 10 μm or less; and the product of i) the content (atom ppm) of the Group 13 element, based on the total number of atoms of constituent elements contained in the first lower-part layer 102 and ii) the layer thickness of the first lower-part layer 102 is from 8 atom ppm·μm or more to 240 atom ppm·μm or less.

This is preferable in order to control the residual potential and keep the pinholes due to insulation breakdown from occurring.

The first lower-part layer 102 may preferably have the layer thickness of 0.1 μm or more in order to keep any potential non-uniformity from occurring, and may preferably have the layer thickness of 10 μm or less in order to keep adherence from lowering. Also, the product of the content (atom ppm) of the Group 13 element, based on the total number of atoms of constituent elements contained in the first lower-part layer 102, and the layer thickness of the first lower-part layer 102 may preferably be 8 atom ppm·μm or more in order to keep the pinholes due to insulation breakdown from occurring, and may preferably be 240 atom ppm·μm or less in order to keep the residual potential from increasing.

The second lower-part layer 103 is formed on the first lower-part layer 102.

Regarding how to form the second lower-part layer 103, source materials therefor, substrate temperature, reactor internal pressure, and discharge frequency used in plasma-assisted CVD, these may be the same as those for the first lower-part layer 102 described above. Like the first lower-part layer 102 described above, a gas containing $H_2$ or halogen atoms may also preferably be mixed in a desired quantity to form the layer. The source gas may further optionally be diluted when used.

The second lower-part layer 103 may also at least be made up of a non-single crystal material containing silicon (a non-single crystal material composed chiefly of silicon atoms). Taking account of electrical properties, it may preferably be a layer further containing a Group 15 element such as phosphorus and nitrogen.

What may effectively be used as materials for incorporating the periodic-table Group 15 element (hereinafter also expressed simply as "Group 15 element") may include, as a source material for incorporating phosphorus atoms, phosphorus hydrides such as $PH_3$ and $P_2H_4$ and phosphorus halides such as $PF_3$, $PF_5$, $PCl_3$, $PCl_5$, $PBr_3$ and $PI_3$. It may further include $PH_4I$. One for incorporating nitrogen atoms may include NO, $NO_2$, $N_2$ and $NH_3$ as what are effective as source materials for incorporating the Group 15 element.

The Group 15 element may preferably be in a content of from $1\times10^{-2}$ atom ppm or more to $1\times10^{4}$ atom ppm or less, much preferably from $5\times10^{-2}$ atom ppm or more to $5\times10^{3}$ atom ppm or less and still much preferably from $1\times10^{-1}$ atom ppm or more to $1\times10^{3}$ atom ppm or less.

Thus incorporating the Group 15 element in the second lower-part layer 103 can block the holes coming from the substrate, to maintain charge characteristics in usual processing of negative charging, and can pass therethrough the electrons among photo-carriers generated in the photoconductive layer, to more keep the residual potential from increasing.

The second lower-part layer 103 may also have a dark conductivity of from $1.0\times10^{-14}$ S/m or more to $1.0\times10^{-9}$ S/m or less. This is preferable in view of electrical properties and in order to keep the pinholes due to insulation breakdown from occurring.

This is because the electrons are larger in mobility than the holes and hence the second lower-part layer 103 can block the holes coming from the cylindrical substrate 101 side in usual processing of negative charging to maintain charge characteristics.

This is also because the second lower-part layer 103 can pass therethrough the electrons among photo-carriers generated in the photoconductive layer 104, to the cylindrical substrate 101 side to make them re-combine with the holes having come to pass through the first lower-part layer 102 from the cylindrical substrate 101 side, and hence can keep the residual potential from increasing.

The second lower-part layer 103 may also be a layer containing at least one kind among carbon atoms and oxygen atoms and containing silicon atoms. This is preferable in view of electrical properties and in order to keep the pinholes due to insulation breakdown from occurring. This is also preferable in order to control the dark conductivity of the second lower-part layer 103 and also in view of improvement in adherence to the first lower-part layer 102 and photoconductive layer 104. As a source material for feeding oxygen atoms, it may include $O_2$ in view of readiness in handling. Also, as a source material for feeding carbon atoms, $CH_4$, $C_2H_2$, $C_2H_4$, $C_2H_6$, $C_3H_8$ or $C_4H_{10}$ may be used as a source gas. In view of good C-feeding efficiency, the material may include $CH_4$, $C_2H_2$ and $C_2H_6$ as preferred ones.

Thus forming the second lower-part layer 103 as the layer containing at least one kind among carbon atoms and oxygen atoms and containing silicon atoms makes it easy to control the dark conductivity of the second lower-part layer 103 so that this layer can;

block the holes coming from the cylindrical substrate 101 side in usual processing of negative charging to maintain charge characteristics; and can pass therethrough the electrons among photo-carriers generated in the photoconductive layer 104, to the cylindrical substrate 101 side to keep the residual potential from increasing.

The Group 15 element, carbon atoms and oxygen atoms contained in the second lower-part layer 103 may also evenly uniformly be distributed in the second lower-part layer 103, or may be contained in such a state that they are distributed non-uniformly in the layer thickness direction. In either case, however, in the in-plane direction parallel to the surface of the cylindrical substrate 101, such atoms may evenly be contained in a uniform distribution. This is preferable also in view of the achievement of uniform properties in the in-plane direction.

The photoconductive layer 104 is formed on the second lower-part layer 103.

The photoconductive layer 104 is made up of a non-single crystal material containing silicon atoms. Stated specifically, it is made up of a non-single crystal material composed chiefly of silicon atoms and further containing hydrogen atoms and/or halogen atoms (hereinafter also expressed as "a-Si(H,X)").

Regarding how to form the photoconductive layer 104, source materials therefor, substrate temperature, reactor internal pressure, and discharge frequency used in plasma-assisted CVD, these may be the same as those for the first lower-part layer 102 described previously. Like the first lower-part layer 102 described previously, a gas containing $H_2$ or halogen atoms may also preferably be mixed in a desired quantity to form the photoconductive layer. The source gas may also optionally be diluted when used.

The photoconductive layer 104 may also preferably have a layer thickness of, but not particularly limited to, from 15 μm or more to 50 μm or less taking account of production cost.

The upper-part layer 105 is formed on the photoconductive layer 104.

Figure 2:
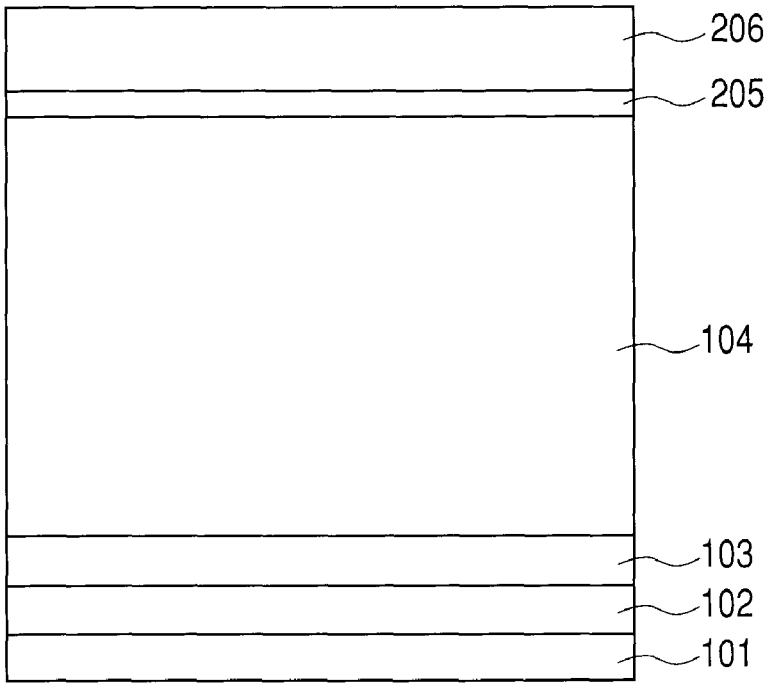
FIG. 2 is a diagrammatic sectional view showing another example of layer configuration of the negatively-chargeable electrophotographic photosensitive member of the present invention.

In the present invention, the upper-part layer 105 may at least have, at its some part, a region capable of retaining electrification charges, and may be formed in a double-layer structure having, as shown in FIG. 2, an upper-part blocking layer 205 having a retention ability for the electrification charges and a surface protective layer 206. It may also be so made up that the proportion of elements constituting the upper-part blocking layer 205 increases from the photoconductive layer 104 side toward the surface side (free-surface side) of the electrophotographic photosensitive member.

The upper-part layer 105 may be formed, like the photoconductive layer 104 described above, by plasma-assisted CVD, sputtering or ion plating. The plasma-assisted CVD is preferred because films having especially high quality can be obtained. As a source material for feeding silicon atoms, a gaseous or gasifiable silicon hydride such as $SiH_4$, $Si_2H_6$, $Si_3H_8$ or $Si_4H_{10}$ may be used as a source gas. In view of readiness in handling for layer formation and Si-feeding efficiency, the material may include $SiH_4$ and $Si_2H_6$ as preferred ones. The upper-part layer 105 may also at least be formed of a non-single crystal material composed chiefly of silicon atoms. Taking account of electrical properties, it may preferably be a silicon carbide layer. As a source material for feeding carbon atoms in forming such a silicon carbide layer, $CH_4$, $C_2H_2$, $C_2H_4$, $C_2H_6$, $C_3H_8$ or $C_4H_{10}$ may be used as a source gas. In view of good C-feeding efficiency, the material may include $CH_4$, $C_2H_2$ and $C_2H_6$ as preferred ones.

The upper-part layer 105 also has the region capable of retaining electrification charges. In order to provide such function, it is necessary for some part of the upper-part layer 105 to be appropriately incorporated with impurity atoms capable of controlling conductivity, or for the proportion of elements constituting the upper-part layer 105 to be so designed that some part of the upper-part layer 105 can have an appropriate dark conductivity. As the impurity atoms used for the purpose of controlling conductivity, a Group 13 element may be used in the present invention. Such a Group 13 element may specifically include boron (B), aluminum (Al), gallium (Ga), indium (In) and thallium (Tl). In particular, boron (B) is preferred. As a source material for feeding boron atoms may include $BCl_3$, $BF_3$, $BBr_3$ and $B_2H_6$. $B_2H_6$ is preferred in view of readiness in handling.

The impurity atoms capable of controlling conductivity which are to be incorporated in the upper-part layer 105 may preferably be in a content, as necessary content, of from 100 atom ppm or more to 30,000 atom ppm or less based on the total number of atoms of constituent elements contained in the upper-part layer 105.

The atoms capable of controlling conductivity which are contained in the upper-part layer 105 may evenly uniformly be distributed in the second lower-part layer 103, or may be contained in such a state that they are distributed non-uniformly in the layer thickness direction. In either case, however, in the in-plane direction parallel to the surface of the cylindrical substrate 101, such atoms may evenly be contained in a uniform distribution. This is preferable also in view of the achievement of uniform properties in the in-plane direction.

Figure 6:
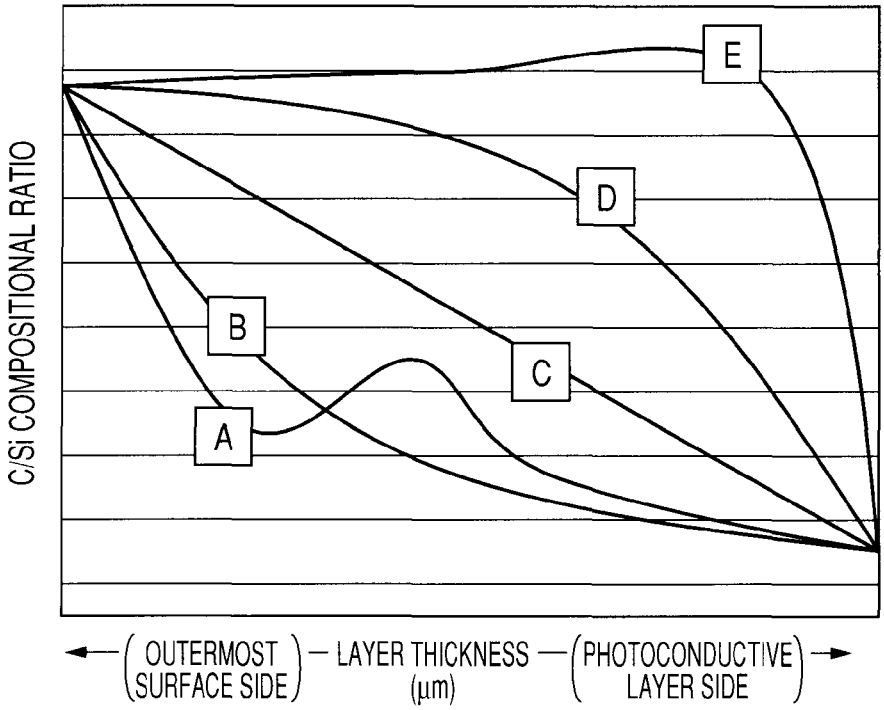
FIG. 6 is a graph diagrammatically showing an example of how the compositional ratio of carbon atoms to silicon atoms changes which constitute the upper-part layer of the negatively-chargeable electrophotographic photosensitive member of the present invention.

The upper-part layer 105 may also have a region where the compositional ratio of carbon atoms to silicon atoms which constitute the upper-part layer 105 increases toward the surface side (free-surface side) of the electrophotographic photosensitive member as shown in FIG. 6. This is preferable in view of the prevention of potential non-uniformity. In that case, as shown by A and E in FIG. 6, the compositional ratio may at least partly increase in the course of its change, or, as shown by B to D, the compositional ratio may monotonously increase in the course of its change. Also, in the course of the change in compositional ratio, it is necessary for the change to pass through such a compositional ratio as to provide a dark conductivity suited for retaining the electrification charges. Such a dark conductivity suited therefor may preferably be from $1.0\times10^{-14}$ S/m or more to $1.0\times10^{-12}$ S/m or less. For such a change in compositional ratio, the upper-part layer may be formed by deposition while individually changing the flow rates of a silicon-containing gas and a carbon-containing gas in the state a high-frequency power is supplied.

As discharge frequency used in plasma-assisted CVD in forming the upper-part layer 105, any frequency may be used. More specifically, preferably usable is either of a high frequency of from 3 MHz or more to less than 30 MHz, which is called an HF band, and a high frequency of from 30 MHz or more to 300 MHz or less, which is called a VHF band.

Figure 5:
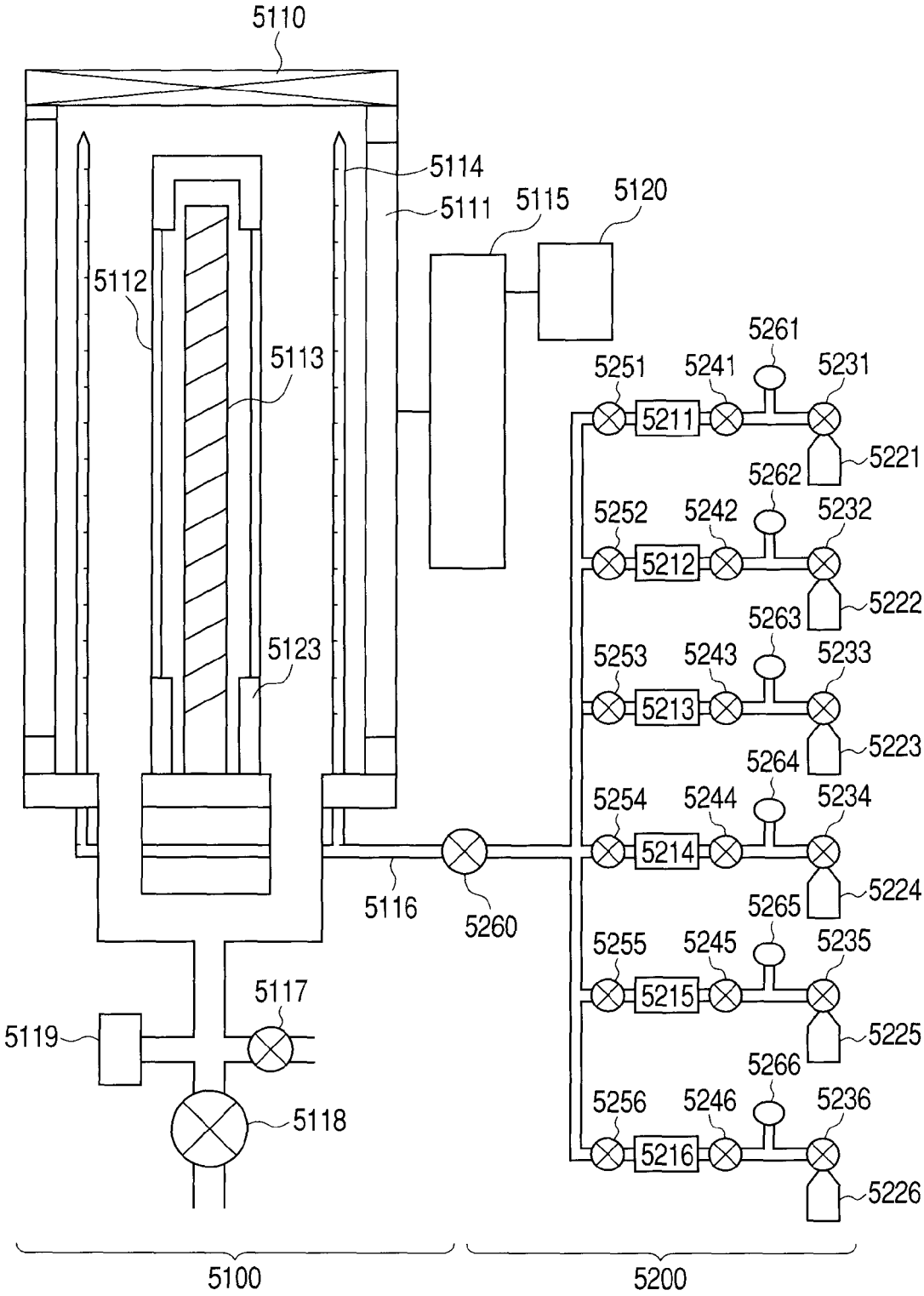
FIG. 5 is a diagrammatic sectional view showing an example of a film forming apparatus for electrophotographic photosensitive members which is of an RF plasma CVD system.

FIG. 5 is a diagrammatic view showing an example of an apparatus for forming films for electrophotographic photosensitive members by RF plasma-assisted CVD making use of a high-frequency power source.

This apparatus is chiefly constituted of a film forming system 5100, a source gas feed system 5200 and an exhaust system (not shown) for evacuating the inside of a film forming furnace 5110. The film forming furnace 5110 in the film forming system 5100 is provided therein with a substrate 5112 connected to the ground, a heater 5113 for heating the substrate, and a gas feed pipe 5114 through which source gases are fed thereinto. A high-frequency power source 5120 is also connected thereto through a high-frequency matching box 5115.

The source gas feed system 5200 is constituted of gas cylinders 5221 to 5226 for source gases such as $SiH_4$, $H_2$, $CH_4$, NO, $B_2H_6$ and $CF_4$, valves 5231 to 5236, 5241 to 5246 and 5251 to 5256, and mass flow controllers 5211 to 5216. The gas cylinders holding therein the respective constituent gases are connected to the gas feed pipe 5114 in the film forming furnace 5110 through an auxiliary valve 5260.

The substrate 5112 is set on a conductive supporting stand 5123 and is thereby connected to the ground.

An example of procedure for forming a photosensitive member by means of the film forming apparatus shown in FIG. 5 is described below.

The substrate 5112 is set in the film forming furnace 5110, and the inside of the film forming furnace 5110 is evacuated by means of an exhaust device (e.g., a vacuum pump; not shown). Subsequently, the temperature of the substrate 5112 is controlled at a desired temperature of from 200° C. to 450° C., preferably from 250° C. to 350° C., by means of the heater 5113 for heating the substrate. Next, source gases for forming the layers of the photosensitive member are flowed into the film forming furnace 5110. Here, gas cylinder valves 5231 to 5236 and a leak valve 5117 of the film forming furnace are checked to make sure that they are closed, and also flow-in valves 5241 to 5246, flow-out valves 5251 to 5256 and the auxiliary valve 5260 are checked to make sure that they are opened. Thereafter, a main valve 5118 is opened to evacuate the insides of the film forming furnace 5110 and a gas feed pipe 5116.

Thereafter, at the time a vacuum gauge 5119 has been read to indicate a pressure of about 0.1 Pa or less, the auxiliary valve 5260 and the flow-out valves 5251 to 5256 are closed. Thereafter, the valves 5231 to 5236 are opened so that gases are respectively introduced from the gas cylinders 5221 to 5226, and the gases are each controlled to have a pressure of 0.2 MPa by operating pressure controllers 5261 to 5266.

Next, the flow-in valves 5241 to 5246 are slowly opened so that gases are respectively introduced into the mass flow controllers 5211 to 5216.

After the film formation has been made ready to start by the above procedure, the first lower-part layer is first formed on the substrate 5112.

That is, at the time the substrate 5112 has come to have the desired temperature, some necessary ones among the flow-out valves 5251 to 5256 and the auxiliary valve 5260 are slowly opened so that desired source gases are fed into the film forming furnace 5110 from the gas cylinders 5221 to 5226 through the gas feed pipe 5114. Next, the mass flow controllers 5211 to 5216 are operated so that each source gas is controlled to flow at a desired rate. In that course, the opening of the main valve 5118 is adjusted while watching the vacuum gauge 5119 so that the pressure inside the film forming furnace 5110 comes to a desired pressure of from 13.3 Pa to 1,330 Pa. At the time the inner pressure has become stable, the high-frequency power source 5120 is set at a desired electric power and a high-frequency power with a frequency of from 1 MHz to 50 MHz, e.g., 13.56 MHz is supplied to a cathode electrode 5111 through the high-frequency matching box 5115 to cause high-frequency glow discharge to take place. The source gases fed into the film forming furnace 5110 are decomposed by the discharge energy thus produced, so that the first lower-part layer composed chiefly of silicon atoms is formed on the support 5112.

After a film with a desired thickness has been formed, the supply of high-frequency power is stopped, and the flow-out valves 5251 to 5256 are closed to stop gases from flowing into the film forming furnace 5110, thus the formation of the first lower-part layer is completed.

Where the second lower-part layer is subsequently formed and also where the photoconductive layer and the upper-part layer are formed, basically the above operation may be repeated.

Figure 7:
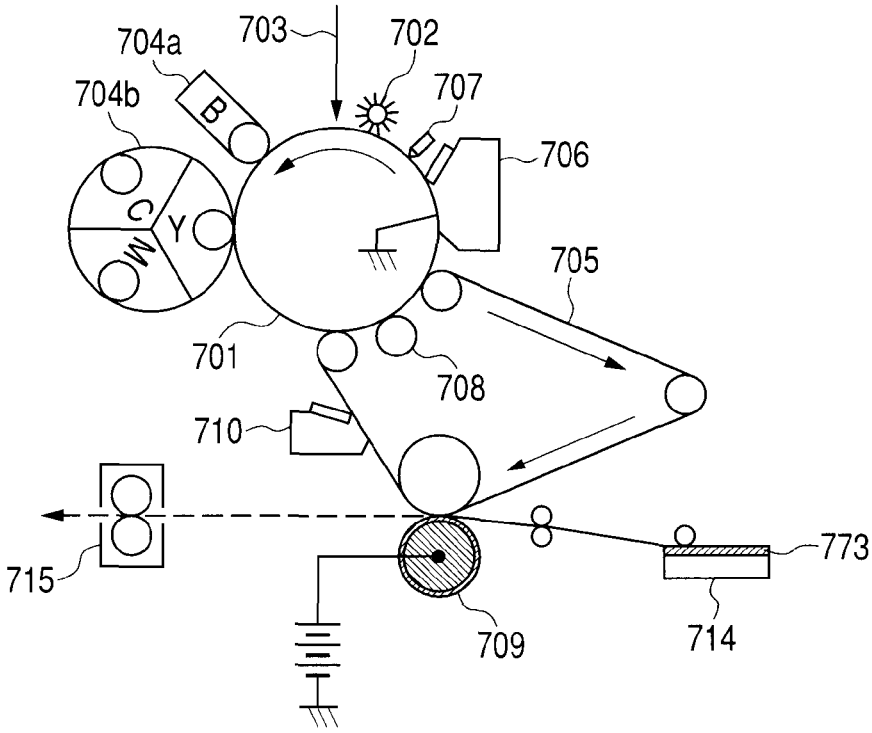
FIG. 7 is a diagrammatic sectional view showing an example of the electrophotographic apparatus of the present invention.

In FIG. 7, an electrophotographic apparatus is diagrammatically shown in which the negatively-chargeable electrophotographic photosensitive member of the present invention is favorably usable.

This electrophotographic apparatus has an electrophotographic photosensitive member (negatively-chargeable electrophotographic photosensitive member) 701 on the surface of which electrostatic latent images are to be formed, where a toner adheres to the electrostatic latent images to form toner images, and which is repeatedly used. Around the electrophotographic photosensitive member 701, disposed are a primary charging assembly (a charging means) 702 with which the surface of the electrophotographic photosensitive member 701 is uniformly electrostatically charged to stated polarity and potential, and an imagewise exposure unit (a latent-image forming means) which performs imagewise exposure on the electrophotographic photosensitive member 701 thus charged, to form electrostatic latent images. Reference numeral 703 denotes imagewise exposure light.

Further disposed around it as developing assemblies (developing means) which make toners adhere to the electrostatic latent images thus formed, to perform development are a first developing assembly 704*a* having a black toner B, and a rotary type second developing assembly 704*b* which is built-in provided with a two-component developing assembly having a yellow toner Y, a two-component developing assembly having a magenta toner M and a two-component developing assembly having a cyan toner C. Further provided are an intermediate transfer belt 705, an electrophotographic photosensitive member cleaner 706 which cleans the surface of the electrophotographic photosensitive member 701, from which the toner images have been transferred to the intermediate transfer belt 705, and a destaticization exposure means 707 which destaticizes the electrophotographic photosensitive member 701.

Here, what is meant by the cleaning is to remove toners (transfer residual toners) having remained on the surface of the electrophotographic photosensitive member after the toner images have been transferred therefrom.

The intermediate transfer belt 705 is so disposed on the electrophotographic photosensitive member 701 as to be driven via a contact nip zone, and is provided on its inside with a primary transfer roller 708 for transferring to the intermediate transfer belt 705 the toner images formed on the electrophotographic photosensitive member 701. To the primary transfer roller 708, a bias power source (not shown) is connected which applies a primary transfer bias for transferring to the intermediate transfer belt 705 the toner images held on the electrophotographic photosensitive member 701. Around the intermediate transfer belt 705, a secondary transfer roller 709 for further transferring to a transfer material 773 the toner images transferred to the intermediate transfer belt 705 is so provided as to come into contact with the bottom part of the intermediate transfer belt 705. To the secondary transfer roller 709, a bias power source is connected which applies a secondary transfer bias for transferring to the transfer material 773 the toner images held on the intermediate transfer belt 705. An intermediate transfer belt cleaner 710 is also provided which is for removing transfer residual toners having remained on the surface of the intermediate transfer belt 705 after the toner images on the intermediate transfer belt 705 have been transferred to the transfer material 773.

In FIG. 7, a step is shown in which the toner images are transferred to the intermediate transfer belt 705 and thereafter the toner images having been transferred to the intermediate transfer belt 705 are transferred to the transfer material 773. Instead, an electrophotographic apparatus is also available which is so set up that the toner images are directly transferred to the transfer material 773 without providing the intermediate transfer belt 705.

This electrophotographic apparatus is also provided with a paper feed cassette 714 which holds therein a plurality of transfer materials 773 on which images are to be formed, and a transport mechanism which transports the transfer material (termed also "recording material" in some cases) 773 from the paper feed cassette 714 via a contact nip zone formed between the intermediate transfer belt 705 and the secondary transfer roller 709. On the transfer material 773 transport path, a fixing assembly 715 is disposed which fixes to the transfer material 773 the toner images having been transferred to the transfer material 773.

As the electrophotographic photosensitive member 701 of the present invention, it is the negatively-chargeable electrophotographic photosensitive member having the cylindrical substrate having a conductive surface and provided thereon the photoconductive layer formed of a non-single crystal material containing silicon atoms, and being characterized by having the first lower-part layer formed of a non-single crystal material containing silicon atoms and the second lower-part layer formed of a non-single crystal material containing silicon atoms which are provided between the substrate and the photoconductive layer, and by further having on the photoconductive layer the upper-part layer formed of a non-single crystal material containing silicon atoms; the first lower-part layer being a layer containing a Group 13 element, and the upper-part layer having a region which contains a Group 13 element. In virtue of such make-up, the negatively-chargeable electrophotographic photosensitive member of the present invention is preferable from the viewpoint of preventing the electrophotographic photosensitive member from its insulation breakdown and from the viewpoint of image quality. The primary charging assembly 702 may also be a contact charging means having magnetic particles which are provided in contact with the electrophotographic photosensitive member 701, and the second developing assembly may be a two-component developing means having a toner and magnetic particles. This is much preferable in view of image quality.

As the imagewise exposure unit, an optical system of color separation/image-forming exposure of color original images may be used, or a scanning exposure system using a laser scanner may be used which outputs laser beams having been modulated corresponding to time-sequential electrical digital image signals of image information, and the electrostatic latent images may be formed on the surface of the electrophotographic photosensitive member by the imagewise exposure method (IAE method) of exposing to light the areas corresponding to image areas. This is much preferable in view of image quality.

The image forming process of the present invention, carried out using this electrophotographic photosensitive member, is described next.

First, as shown by arrows in FIG. 7, the electrophotographic photosensitive member 701 is rotatingly driven in the clockwise direction at a stated process speed and the intermediate transfer belt 705 is rotatingly driven in the anticlockwise direction at the same peripheral speed as the electrophotographic photosensitive member 701.

The electrophotographic photosensitive member 701 is, in the course of its rotation, subjected to uniform charging to stated polarity and potential by means of the primary charging assembly 702, and thereafter subjected to the imagewise exposure. Thus, an electrostatic latent image corresponding to a first-color component image (e.g., a magenta component image) of the intended color image is formed on the surface of the electrophotographic photosensitive member 701.

Then, the second developing assembly is rotated, and the two-component developing assembly which makes a magenta toner M adhere is set at a stated position, and the electrostatic latent image is developed with the first-color magenta toner M. At this stage, the first developing assembly 704*a* is so kept unoperated as not to act on the electrophotographic photosensitive member 701, and by no means affects the first-color magenta toner image.

As the development bias in the two-component developing assembly, the voltage formed by superimposing a DC voltage and an AC voltage as shown in FIG. 8 is used. Here, where the value of the DC voltage is represented by Vdc and the value of a peak-to-peak voltage between the positive and negative sides of the AC voltage is represented by Vpp, the relationship between these may be $150\,V \leqq |Vpp|/2-|Vdc| \leqq 1{,}500\,V$. This is much preferable in view of image quality.

The first-color magenta toner image thus formed and held on the electrophotographic photosensitive member 701 passes through the nip zone 705 between the electrophotographic photosensitive member 701 and the intermediate transfer belt 705, in the course of which it is transferred to the outer peripheral surface of the intermediate transfer belt 705 by the aid of an electric field formed upon application of primary transfer bias from a bias power source (not shown) to the primary transfer roller 708.

The surface of the electrophotographic photosensitive member 701 from which the first-color magenta toner image has been transferred to the intermediate transfer belt 705 is cleaned with the electrophotographic photosensitive member cleaner 706. Next, on the surface thus cleaned, of the electrophotographic photosensitive member 701, a second-color toner image (e.g., a cyan toner image) is formed in the same way as the formation of the first-color toner image. This second-color toner image is transferred onto the intermediate transfer belt 705 to which the first-color toner image has been transferred.

Subsequently, a third-color toner image (e.g., a yellow toner image) and a fourth-color toner image (e.g., a black toner image) are likewise formed and transferred onto the intermediate transfer belt 705, thus a synthesized color toner image is formed which corresponds to the intended color image.

Next, the transfer material 773 is fed at given timing, from the paper feed cassette 714 to the contact nip zone to be formed between the intermediate transfer belt 705 and the secondary transfer roller 709. Then the secondary transfer roller 709 is brought into contact with the intermediate transfer belt 705. At the time the secondary transfer roller 709 has been brought into contact with the intermediate transfer belt 705, secondary transfer bias is applied from a bias power source to the secondary transfer roller 709. As the result, the synthesized color toner image formed by superimposedly transferring the toner images onto the intermediate transfer belt 705 is transferred to the transfer material 773 that is a second image bearing member. After the synthesized color toner image has been transferred to the transfer material 773, transfer residual toners on the intermediate transfer belt 705 are removed by means of the intermediate transfer belt cleaner 710. The transfer material 773 to which the synthesized color toner image has been transferred is guided to the fixing assembly 715, where the synthesized color toner image is fixed with heating.

In the operation of this electrophotographic apparatus, the secondary transfer roller 709 and the intermediate transfer belt cleaner 710 are so made as to be kept separate from the intermediate transfer belt 705 during the execution of the successive transfer of the first- to fourth-color toner images from the electrophotographic photosensitive member 701 to the intermediate transfer belt 705.

EXPERIMENTS

In the negatively-chargeable electrophotographic photosensitive member of the present invention, the lower-part layer (lower-part blocking layer) is formed in the double-layer structure that it has the first lower-part layer having a blocking ability chiefly against electrons and the second lower-part layer having a blocking ability chiefly against holes, and this has enabled high-level achievement of both the properties against dark attenuation and residual potential and the prevention of insulation breakdown. In order to verify the function of these first lower-part layer and second lower-part layer, the following experiments were conducted.

Experiment 1

Using the a-Si photosensitive member film forming apparatus of an RF plasma-assisted CVD system as shown in FIG. 5, a negatively-chargeable electrophotographic photosensitive member was produced by forming layers on an aluminum cylindrical support of 84 mm in diameter under conditions shown in Table 1. The negatively-chargeable electrophotographic photosensitive member had, on the substrate, a first lower-part layer, a second lower-part layer, a photoconductive layer and an upper-part layer consisting of an upper-part blocking layer and a surface protective layer which were formed (layered) in this order from the substrate side.

The first lower-part layer was made up of a non-single crystal material containing silicon atoms and further contained a Group 13 element. The second lower-part layer was also made up of a non-single crystal material containing silicon atoms. The upper-part layer was made up of a non-single crystal material containing silicon atoms and had a region capable of retaining electrification charges.

The electrophotographic photosensitive member thus produced was evaluated in the following way on the items of positive chargeability and negative chargeability. The results are shown in Table 4.

TABLE 1

| | | | | Upper-part layer | |
|---|---|---|---|---|---|
| Gases & Gas flow rates | First lower = part layer | Second lower = part layer | Photo-conductive layer | Upper = part blocking layer | Surface protective layer |
| $SiH_4$ [ml/min (normal)] | 100 | 100 | 100 | 90 | 10 |
| $H_2$ [ml/min (normal)] | 600 | 500 | 800 | — | — |
| $B_2H_6$ (ppm) (based on $SiH_4$) | 1,000 | — | — | 300 | — |

TABLE 1-continued

| Gases & Gas flow rates | First lower = part layer | Second lower = part layer | Photo-conductive layer | Upper-part layer: Upper = part blocking layer | Upper-part layer: Surface protective layer |
|---|---|---|---|---|---|
| NO [ml/min (normal)] | — | 8 | — | — | — |
| $CH_4$ [ml/min (normal)] | — | 700 | — | 90 | 600 |
| Substrate temp. (° C.) | 260 | 260 | 260 | 260 | 260 |
| Reactor internal Pressure (Pa) | 64 | 64 | 79 | 60 | 60 |
| High-frequency power (W) | 100 | 200 | 400 | 300 | 180 |
| Layer thickness (μm) | 1.5 | 1.5 | 25 | 0.2 | 0.8 |

Positive Chargeability

The electrophotographic photosensitive member produced was set in the chargeability measuring instrument shown in FIG. 4. The electrophotographic photosensitive member was provided on its surface with positive electric charges of 2,000 $\mu C/m^2$ by using a positive-charging corona charging assembly as the charging means, and thereafter this was left to stand for 0.18 second, after which the surface potential of the electrophotographic photosensitive member was measured to regard it as positive chargeability. Results obtained were ranked according to the following criteria.

A: One having a surface potential of 50 V or more.

B: One having a surface potential of less than 50 V.

Negative Chargeability

The electrophotographic photosensitive member produced was set in the chargeability measuring instrument shown in FIG. 4. The electrophotographic photosensitive member was provided on its surface with negative electric charges of −2,000 $\mu C/m^2$ by using a positive-charging corona charging assembly as the charging means, and thereafter this was left to stand for 0.18 second, after which the surface potential of the electrophotographic photosensitive member was measured to regard it as negative chargeability. Results obtained were ranked according to the following criteria.

A: One having a surface potential of 50 V or more.

B: One having a surface potential of less than 50 V.

Experiment 2

In the procedure of Experiment 1, a negatively-chargeable electrophotographic photosensitive member was produced under conditions shown in Table 2, in the same way except that the second lower-part layer was not formed and instead only the first lower-part layer was formed.

The electrophotographic photosensitive member thus produced was evaluated on the items of positive chargeability and negative chargeability in the same way as in Experiment 1. The results are shown in Table 4.

TABLE 2

| Gases & gas flow rates | First lower-part layer | Photo-conductive layer | Upper-part layer: Upper = part blocking layer | Upper-part layer: Surface protective layer |
|---|---|---|---|---|
| $SiH_4$ [ml/min(normal)] | 100 | 100 | 90 | 10 |
| $H_2$ [ml/min(normal)] | 600 | 800 | — | — |

TABLE 2-continued

| Gases & gas flow rates | First lower-part layer | Photo-conductive layer | Upper-part layer: Upper = part blocking layer | Upper-part layer: Surface protective layer |
|---|---|---|---|---|
| $B_2H_6$ (ppm) (based on $SiH_4$) | 1,000 | — | 300 | — |
| NO [ml/min(normal)] | — | — | — | — |
| $CH_4$ [ml/min(normal)] | — | — | 90 | 600 |
| Substrate temp. (° C.) | 260 | 260 | 260 | 260 |
| Reactor internal pressure (Pa) | 64 | 79 | 60 | 60 |
| High-frequency power (W) | 100 | 400 | 300 | 180 |
| Layer thickness (μm) | 1.5 | 25 | 0.2 | 0.8 |

Experiment 3

In the procedure of Experiment 1, a negatively-chargeable electrophotographic photosensitive member was produced under conditions shown in Table 3, in the same way except that the first lower-part layer was not formed and instead only the second lower-part layer was formed.

The electrophotographic photosensitive member thus produced was evaluated on the items of positive chargeability and negative chargeability in the same way as in Experiment 1. The results are shown in Table 4.

TABLE 3

| Gases & gas flow rates | Second lower-part layer | Photo-conductive layer | Upper-part layer: Upper = part blocking layer | Upper-part layer: Surface protective layer |
|---|---|---|---|---|
| $SiH_4$ [ml/min(normal)] | 100 | 100 | 90 | 10 |
| $H_2$ [ml/min(normal)] | 500 | 800 | — | — |
| $B_2H_6$ (ppm) (based on $SiH_4$) | — | — | 300 | — |
| NO [ml/min(normal)] | 8 | — | — | — |
| $CH_4$ [ml/min(normal)] | 700 | — | 90 | 600 |
| Substrate temp. (° C.) | 260 | 260 | 260 | 260 |
| Reactor internal pressure (Pa) | 64 | 79 | 60 | 60 |

TABLE 3-continued

| Gases & gas flow rates | Second lower-part layer | Photo-conductive layer | Upper-part layer: Upper = part blocking layer | Upper-part layer: Surface protective layer |
|---|---|---|---|---|
| High-frequency power (W) | 200 | 400 | 300 | 180 |
| Layer thickness (μm) | 1.5 | 25 | 0.2 | 0.8 |

TABLE 4

| | Experiment 1 | Experiment 2 | Experiment 3 |
|---|---|---|---|
| Positive chargeability (V) | A | A | B |
| Negative chargeability (V) | A | B | A |

As is seen from the results shown in Table 4, in the case when the charge polarity is negative, the electrophotographic photosensitive member of Experiment 2, in which only the first lower-part layer having a blocking ability chiefly against electrons is formed as the lower-part layer, can not block the holes coming from the substrate side, and hence the negative chargeability is not achievable. However, in the case when the charge polarity is positive, it can block the electrons coming from the substrate side, and hence the positive chargeability is achievable.

The electrophotographic photosensitive member of Experiment 3, in which only the second lower-part layer having a blocking ability chiefly against holes is formed as the lower-part layer, has resulted in reverse. That is, in the case when the charge polarity is negative, it can block the holes coming from the substrate side, and hence the negative chargeability is achievable, whereas, in the case when the charge polarity is positive, it can not block the electrons coming from the substrate side, and hence the positive chargeability is not achievable.

From these results, it is seen that the first lower-part layer and the second lower-part layer which are used in the negatively-chargeable electrophotographic photosensitive member of the present invention have the function as a layer having a blocking ability chiefly against electrons and as a layer having a blocking ability chiefly against holes, respectively. Then, in Experiment 1, in which these two lower-part layers are provided, it has been ascertained that the electrophotographic photosensitive member is chargeable both positively and negatively.

EXAMPLES

The present invention is described below in greater detail by giving Examples and Comparative Examples.

The present invention is by no means limited by these Examples.

Example 1

Using the a-Si photosensitive member film forming apparatus of an RF plasma-assisted CVD system as shown in FIG. 5, a negatively-chargeable electrophotographic photosensitive member was produced by forming layers on an aluminum support of 84 mm in diameter under conditions shown in Table 5. The negatively-chargeable electrophotographic photosensitive member had, on the substrate, a first lower-part layer, a second lower-part layer, a photoconductive layer and an upper-part layer consisting of an upper-part blocking layer and a surface protective layer which were formed in this order from the substrate side.

TABLE 5

| Gases & gas flow rates | First lower = part layer | Second lower = part layer | Photo-conductive layer | Upper-part layer: Upper = part blocking layer | Upper-part layer: Surface protective layer |
|---|---|---|---|---|---|
| $SiH_4$ [ml/min (normal)] | 100 | 100 | 100 | 90 | 10 |
| $H_2$ [ml/min (normal)] | 600 | 500 | 800 | — | — |
| $B_2H_6$ (ppm) (based on $SiH_4$) | 300 | — | — | — | — |
| $CH_4$ [ml/min (normal)] | — | — | — | 630 | 600 |
| Substrate temp. (° C.) | 260 | 260 | 260 | 260 | 260 |
| Reactor internal pressure (Pa) | 64 | 64 | 79 | 60 | 60 |
| High-frequency power (W) | 100 | 200 | 400 | 300 | 180 |
| Layer thickness (μm) | 1.5 | 1.5 | 25 | 0.2 | 0.8 |

The first lower-part layer was made up of a non-single crystal material containing silicon atoms and further contained a Group 13 element. The second lower-part layer was made up of a non-single crystal material containing silicon atoms. The upper-part layer was made up of a non-single crystal material containing silicon atoms and had a region capable of retaining electrification charges.

The electrophotographic photosensitive member thus produced was evaluated in the following way on the items of negative chargeability, residual potential, insulation breakdown preventability, adherence, potential non-uniformity and overall evaluation. The results are shown in Table 34.

Negative Chargeability

The negatively-chargeable electrophotographic photosensitive member produced was set in the chargeability measuring instrument shown in FIG. 4. The electrophotographic photosensitive member was provided on its surface with negative electric charges of −2,000 μC/m$^2$ by using a negatively-chargeable corona charging assembly as the charging means. Thereafter, this was left to stand for 0.18 second, after which the surface potential of the electrophotographic photosensitive member was measured to regard it as negative chargeability. Results obtained were ranked by relative evaluation made assuming the value of the negatively-chargeable electrophotographic photosensitive member of Example 1 as reference (100%).

AAA: From 130% or more to less than 150%, being at a very good level.

AA: From 110% or more to less than 130%, being at a good level.

A: From 90% or more to less than 110%, being substantially at the same level as the reference.

Residual Potential

The negatively-chargeable electrophotographic photosensitive member produced was set in an electrophotographic apparatus. Thereafter, its charging assembly was so controlled that the electrophotographic photosensitive member had a surface potential of −450 V (dark potential) at the position of a black developing assembly, and thereafter the amount of light of an imagewise exposure light source was so controlled as to be maximal, where the electrophotographic photosensitive member was exposed to imagewise exposure light and its surface potential was measured with a surface potentiometer set at the position of the black developing assembly to find residual potential. Results obtained were ranked according to the judgment criteria shown below.

The electrophotographic apparatus used here was an electrophotographic apparatus iRC6800 (trade name), manufactured by CANON INC., which was so converted for experiment that the charging polarity was polarity for negative charging and also the amount of light of the imagewise exposure light source was controllable, and in which the surface potentiometer was set at the position of the black developing assembly.

A: The residual potential is from 0 V to 50 V, being at a good level in practical use.

B: The residual potential is from 51 V to 100 V, being at a level of no problem in practical use.

C: The residual potential is 101 V or more, being at a level that may come into question in practical use.

Insulation Breakdown Preventability

The pinholes of the electrophotographic photosensitive member as questioned in the present invention occurs when, at a two-component developing bias being under certain conditions, any inclusion of conductive foreign matter in the developing zone at which the developer carrying member for two-component development type developers faces the electrophotographic photosensitive member brings about the phenomenon that electric charges concentrate locally on the electrophotographic photosensitive member through such foreign matter serving as a conductive path; the phenomenon being the trigger of such pinholes. Because of this phenomenon that electric charges concentrate locally on the electrophotographic photosensitive member, the electrophotographic photosensitive member may undergo insulation breakdown to cause pinholes in the electrophotographic photosensitive member. Then, it has been ascertained that, at places where such a phenomenon that electric charges concentrate locally on the electrophotographic photosensitive member has occurred, the surface potential of the electrophotographic photosensitive member comes into disorder, so that the toner may participate in development in the shape of solids or rings to come to appear on images as spots in the shape of solids or rings.

Thus, making sure of such spots on images makes it ascertainable whether or not any inclusion of conductive foreign matter in the developing zone at which the developer carrying member for two-component development type developers faces the electrophotographic photosensitive member has brought about the phenomenon that electric charges concentrate locally on the electrophotographic photosensitive member through such foreign matter serving as a conductive path. Also, the positions on the electrophotographic photosensitive member that correspond to such spots may be observed, whereby it can be recognized whether or not the electrophotographic photosensitive member has undergone insulation breakdown to cause pinholes therein.

Stated specifically, the negatively-chargeable electrophotographic photosensitive member produced was set in an electrophotographic apparatus to reproduce images with a pixel density of 0%.

The electrophotographic apparatus used here was an electrophotographic apparatus iRC6800 (trade name), manufactured by CANON INC., which was so converted for experiment that the charging polarity was polarity for negative charging, the amount of light of the imagewise exposure light source was controllable and also the condition for two-component development bias was controllable, and in which a developing assembly in the two-component developer of which an iron powder was mixed in a very small quantity was used as a two-component developing assembly for a magenta toner.

In this image reproduction, every time the above spots in the shape of solids or rings come to appear on images, the places corresponding to such spots on the electrophotographic photosensitive member were observed to examine whether or not the pinholes occurred which were due to insulation breakdown of the electrophotographic photosensitive member. Then, if such pinholes were not seen to have occurred, this procedure was repeated to reproduce the images with a pixel density of 0% without changing the condition for two-component development bias until the pinholes came to occur or the spots in the shape of solids or rings numbered 1,000 spots. Then, if the pinholes were not seen to have occurred even at a time of point that the spots in the shape of solids or rings reached 1,000 spots, the condition for two-component development bias were changed (stated specifically, the peak-to-peak voltage Vpp between the positive and negative sides of the AC voltage was made higher). Then, this procedure was repeated until the conditions came to those which caused the insulation breakdown, and the minimum value of $|Vpp|/2-|Vdc|$ at which the insulation breakdown occurred was taken as insulation breakdown preventability. Results obtained were ranked according to the judgment criteria shown below, assuming the value of the negatively-chargeable electrophotographic photosensitive member of Example 1 as reference (100%).

AAA: From 170% or more, being at a very good level.

AA: From 110% or more to less than 170%, being at a good level.

A: From 90% or more to less than 110%, being substantially at the same level as the reference.

B: From 60% or more to less than 90%, being at a level of no problem in practical use.

C: Less than 60% relative to the reference, being at a level that may come into question in practical use.

Adherence

Adherence between layers of the negatively-chargeable electrophotographic photosensitive member produced was measured with HEIDON (Type: 14S), manufactured by Shinto Kagaku Kogyo K.K. Using this instrument, the surface of the photosensitive member in which the respective layers were formed was scratched with a diamond needle, and the adherence between the layer and the layer was evaluated by the measure of the load applied to the diamond needle when the electrophotographic photosensitive member surface came to peel. Results obtained were ranked according to the judgment criteria shown below, assuming the value of the negatively-chargeable electrophotographic photosensitive member of Example 1 as reference (100%).

A: From 90% or more to less than 105%, being substantially at the same level as the reference.

B: From 90% or more to less than 95%, being at a level of no problem in practical use.

Potential Non-Uniformity

The negatively-chargeable electrophotographic photosensitive member produced was set in an electrophotographic apparatus. Its charging assembly was so adjusted as to give a dark-area potential of −450 V at the position of a black developing assembly and the amount of light of an exposure light source was so adjusted as to give a light-area potential of −100 V at the position of the black developing assembly. In this state, the in-plane distribution of the dark-area potential and light-area potential was measured, and a difference between their maximum values and minimum values was taken as potential non-uniformity. Results obtained were ranked according to the judgment criteria shown below, assuming the value of the negatively-chargeable electrophotographic photosensitive member of Example 1 as reference (100%).

The electrophotographic apparatus used here was an electrophotographic apparatus iRC6800 (trade name), manufactured by CANON INC., which was so converted for experiment that the charging polarity was polarity for negative charging and also the amount of light of the imagewise exposure light source was controllable, and in which a surface potentiometer was set at the position of the black developing assembly.

AA: From 120% or more, being at a good level.

A: From 80% or more to less than 120%, being substantially at the same level as the reference.

B: Less than 80%, but being at a level of no problem in practical use.

Overall Evaluation

The results obtained in the evaluation of negative chargeability, residual potential, insulation breakdown preventability, adherence and potential non-uniformity were ranked by overall evaluation as shown below, on the bases of points found by summing up points for the rank "AAA" as 4 points, the rank "AA" as 3 points, the rank "A" as 2 points, the rank "B" as 1 point and the rank "C" as 0 point. About the insulation breakdown preventability, it was the item on which the effect of the present invention was most brought out, and hence calculated by doubling its points.

AAA: From 17 points or more to 19 points or less, and free of the ranks "B" and "C" (very excellent).

AA: From 14 points or more to 16 points or less, and free of the ranks "B" and "C" (excellent).

A: From 12 points or more to 13 points or less, and free of the ranks "B" and "C" (better).

B: Even just one is found for the rank "B" (good).

D: Even just one is found for the rank "C" (there may be a problem in practical use).

Example 2

In the procedure of Example 1, negatively-chargeable electrophotographic photosensitive members were produced as Examples 2-1 and 2-2 under conditions shown in Tables 6 and 7 respectively corresponding thereto, in the same way except that the second lower-part layers were each formed as a layer made up of a non-single crystal material containing silicon atoms and containing a Group 15 element.

The negatively-chargeable electrophotographic photosensitive members thus produced were evaluated on the items of negative chargeability, residual potential, insulation breakdown preventability, adherence, potential non-uniformity and overall evaluation in the same way as in Example 1. The results are shown in Table 34.

TABLE 6

| | | | | Upper-part layer | |
|---|---|---|---|---|---|
| Gases & gas flow rates | First lower = part layer | Second lower = part layer | Photo-conductive layer | Upper = part blocking layer | Surface protective layer |
| $SiH_4$ [ml/min (normal)] | 100 | 100 | 100 | 90 | 10 |
| $H_2$ [ml/min (normal)] | 600 | 500 | 800 | — | — |
| $B_2H_6$ (ppm) (based on $SiH_4$) | 300 | — | — | — | — |
| NO [ml/min (normal)] | — | 8 | — | — | — |
| $CH_4$ [ml/min (normal)] | — | — | — | 630 | 600 |
| Substrate temp. (° C.) | 260 | 260 | 260 | 260 | 260 |
| Reactor internal pressure (Pa) | 64 | 64 | 79 | 60 | 60 |
| High-frequency power (W) | 100 | 200 | 400 | 300 | 180 |
| Layer thickness (μm) | 1.5 | 1.5 | 25 | 0.2 | 0.8 |

TABLE 7

| Gases & gas flow rates | First lower = part layer | Second lower = part layer | Photo-conductive layer | Upper-part layer: Upper = part blocking layer | Upper-part layer: Surface protective layer |
|---|---|---|---|---|---|
| $SiH_4$ [ml/min (normal)] | 100 | 100 | 100 | 90 | 10 |
| $H_2$ [ml/min (normal)] | 600 | 500 | 800 | — | — |
| $B_2H_6$ (ppm) (based on $SiH_4$) | 300 | — | — | — | — |
| $PH_3$ (ppm) (based on $SiH_4$) | — | 300 | — | — | — |
| $CH_4$ [ml/min (normal)] | — | — | — | 630 | 600 |
| Substrate temp. (° C.) | 260 | 260 | 260 | 260 | 260 |
| Reactor internal pressure (Pa) | 64 | 64 | 79 | 60 | 60 |
| High-frequency power (W) | 100 | 200 | 400 | 300 | 180 |
| Layer thickness (μm) | 1.5 | 1.5 | 25 | 0.2 | 0.8 |

Example 3

In the procedure of Example 1, negatively-chargeable electrophotographic photosensitive members were produced as Examples 3-1 to 3-5 under conditions shown in Tables 8 and 9, in the same way except that, in forming second lower-part layers, $N_2$ was added at different flow rates to make the second lower-part layers have different dark conductivity. The negatively-chargeable electrophotographic photosensitive members thus produced were evaluated on the items of negative chargeability, residual potential, insulation breakdown preventability, adherence, potential non-uniformity and overall evaluation in the same way as in Example 1. The results are shown in Table 34. Here, the dark conductivity of the lower-part layer used in this Example was measured in the following way. The results are shown together in Table 9.

How to Measure Dark Conductivity

First, a thin film with sole composition was formed on a glass substrate by using the method for forming the layer to be measured (the first lower-part layer and second lower-part layer in Example 3). As the glass substrate, it is preferable to use Na-free one. For example, #7059, available from Corning Glass Works, may be used. Using this substrate, a film equivalent to the layer to be measured was formed by deposition in a thickness of about 1 μm. Next, a mask for a comb-shaped electrode was closely bonded to the sample layer on this glass substrate, and Cr was deposited thereon in a thickness of 100 nm by vacuum deposition to prepare the comb-shaped electrode. Then, in a dark place, a voltage of from tens of V to 100 V was applied to this comb-shaped electrode, and electric current flowing therethrough was measured with a pA meter (used was 4140B, manufactured by HP Co.). From the values thus found, the dark conductivity of the layer to be measured was calculated.

TABLE 8

| Gases & gas flow rates | First lower = part layer | Second lower = part layer | Photo-conductive layer | Upper-part layer: Upper = part blocking layer | Upper-part layer: Surface protective layer |
|---|---|---|---|---|---|
| $SiH_4$ [ml/min (normal)] | 100 | 50 | 100 | 90 | 10 |
| $H_2$ [ml/min (normal)] | 600 | — | 800 | — | — |
| $B_2H_6$ (ppm) (based on $SiH_4$) | 300 | — | — | — | — |
| $N_2$ [ml/min (normal)] | — | Varied | — | — | — |
| $CH_4$ [ml/min (normal)] | — | — | — | 630 | 600 |
| Substrate temp. (° C.) | 260 | 260 | 260 | 260 | 260 |
| Reactor internal pressure (Pa) | 64 | 64 | 79 | 60 | 60 |
| High-frequency power (W) | 100 | 200 | 400 | 300 | 180 |
| Layer thickness (μm) | 1.5 | 1.5 | 25 | 0.2 | 0.8 |

TABLE 9

| | Example | | | | |
|---|---|---|---|---|---|
| | 3-1 | 3-2 | 3-3 | 3-4 | 3-5 |
| $N_2$ flow rate [ml/min (normal)] in forming second lower-part layer | 20 | 30 | 200 | 700 | 800 |
| Dark conductivity (S/m) | $9.97 \times 10^{-80}$ | $1.07 \times 10^{-09}$ | $2.56 \times 10^{-12}$ | $9.96 \times 10^{-13}$ | $1.12 \times 10^{-14}$ |

Example 4

In the procedure of Example 1, three kinds of negatively-chargeable electrophotographic photosensitive members were produced as Examples 4-1 to 4-3 under conditions shown in Tables 10 to 12 respectively corresponding thereto, in the same way except that the second lower-part layers were each formed as a layer containing at least one kind of carbon atoms and oxygen atoms. These were evaluated on the items of negative chargeability, residual potential, insulation breakdown preventability, adherence, potential non-uniformity and overall evaluation in the same way as in Example 1. The results are shown in Table 34.

TABLE 10

| | | | | Upper-part layer | |
|---|---|---|---|---|---|
| Gases & gas flow rates | First lower = part layer | Second lower = part layer | Photo-conductive layer | Upper = part blocking layer | Surface protective layer |
| $SiH_4$ [ml/min (normal)] | 100 | 100 | 100 | 90 | 10 |
| $H_2$ [ml/min (normal)] | 600 | 500 | 800 | — | — |
| $B_2H_6$ (ppm) (based on $SiH_4$) | 300 | — | — | — | — |
| $CH_4$ [ml/min (normal)] | — | 700 | — | 630 | 600 |
| Substrate temp. (° C.) | 260 | 260 | 260 | 260 | 260 |
| Reactor internal pressure (Pa) | 64 | 64 | 79 | 60 | 60 |
| High-frequency power (W) | 100 | 200 | 400 | 300 | 180 |
| Layer thickness (μm) | 1.5 | 1.5 | 25 | 0.2 | 0.8 |

TABLE 11

| | | | | Upper-part layer | |
|---|---|---|---|---|---|
| Gases & gas flow rates | First lower = part layer | Second lower = part layer | Photo-conductive layer | Upper = part blocking layer | Surface protective layer |
| $SiH_4$ [ml/min (normal)] | 100 | 100 | 100 | 90 | 10 |
| $H_2$ [ml/min (normal)] | 600 | 500 | 800 | — | — |
| $B_2H_6$ (ppm) (based on $SiH_4$) | 300 | — | — | — | — |
| $CH_4$ [ml/min (normal)] | — | 50 | — | 630 | 600 |
| $O_2$ [ml/min (normal)] | — | 5 | — | — | — |
| Substrate temp. (° C.) | 260 | 260 | 260 | 260 | 260 |
| Reactor internal pressure (Pa) | 64 | 64 | 79 | 60 | 60 |
| High-frequency power (W) | 100 | 200 | 400 | 300 | 180 |
| Layer thickness (μm) | 1.5 | 1.5 | 25 | 0.2 | 0.8 |

TABLE 12

| Gases & gas flow rates | First lower = part layer | Second lower = part layer | Photo-conductive layer | Upper-part layer: Upper = part blocking layer | Upper-part layer: Surface protective layer |
|---|---|---|---|---|---|
| $SiH_4$ [ml/min (normal)] | 100 | 100 | 100 | 90 | 10 |
| $H_2$ [ml/min (normal)] | 600 | 500 | 800 | — | — |
| $B_2H_6$ (ppm) (based on $SiH_4$) | 300 | — | — | — | — |
| $CH_4$ [ml/min (normal)] | — | — | — | 630 | 600 |
| $O_2$ [ml/min (normal)] | — | 5 | — | — | — |
| Substrate temp. (° C.) | 260 | 260 | 260 | 260 | 260 |
| Reactor internal Pressure (Pa) | 64 | 64 | 79 | 60 | 60 |
| High-frequency power (W) | 100 | 200 | 400 | 300 | 180 |
| Layer thickness (μm) | 1.5 | 1.5 | 25 | 0.2 | 0.8 |

Example 5

In the procedure of Example 4-1, seven kinds of negatively-chargeable electrophotographic photosensitive members were respectively produced as Examples 5-1 to 5-7 in the same way except that the first lower-part layer film forming time was varied to make the first lower-part layers have different layer thickness as shown in Table 13. These were evaluated on the items of negative chargeability, residual potential, insulation breakdown preventability, adherence, potential non-uniformity and overall evaluation in the same way as in Example 1. The results are shown in Table 34.

TABLE 13

| | Example 5-1 | 5-2 | 5-3 | 5-4 | 5-5 | 5-6 | 5-7 |
|---|---|---|---|---|---|---|---|
| Layer thickness (μm) of first lower-part layer | 0.09 | 0.1 | 0.2 | 3 | 9 | 10 | 11 |

Example 6

In the procedure of Example 5-2, negatively-chargeable electrophotographic photosensitive members were produced as Examples 6-1 to 6-8 in the same way except that the flow rate of $B_2H_6$ in forming first lower-part layers was varied to make the first lower-part layers have different content of Group 13 element (boron) based on the total number of atoms of the constituent elements contained therein. Conditions under which these were produced are shown in Tables 14 and 15. These were evaluated on the items of negative chargeability, residual potential, insulation breakdown preventability, adherence, potential non-uniformity and overall evaluation in the same way as in Example 1. The results are shown in Table 34.

The flow rates of $B_2H_6$ in forming the first lower-part layers when the negatively-chargeable electrophotographic photosensitive members of Examples 6-1 to 6-8 were produced and the content of Group 13 element (boron) based on the total number of atoms of the constituent elements contained in each first lower-part layer are shown in Table 14. The content of Group 13 element (boron) was measured by SIMS (secondary ion mass spectroscopy) (using IMS-4F, manufactured by Cameca Instruments, Inc.).

TABLE 14

| Gases & Gas flow rates | First lower = part layer | Second lower = part layer | Photo-conductive layer | Upper-part layer: Upper = part blocking layer | Upper-part layer: Surface protective layer |
|---|---|---|---|---|---|
| $SiH_4$ [ml/min (normal)] | 100 | 100 | 100 | 90 | 10 |
| $H_2$ [ml/min (normal)] | 600 | 500 | 800 | — | — |
| $B_2H_6$ ppm) (based on $SiH_4$) | Varied | — | — | — | — |
| $CH_4$ [ml/min (normal)] | — | — | — | 630 | 600 |
| Substrate temp. (° C.) | 260 | 260 | 260 | 260 | 260 |
| Reactor internal pressure (Pa) | 64 | 64 | 79 | 60 | 60 |
| High-frequency power (W) | 100 | 200 | 400 | 300 | 180 |
| Layer thickness (μm) | 0.1 | 1.5 | 25 | 0.2 | 0.8 |

TABLE 15

| | Example | | | | | | | |
|---|---|---|---|---|---|---|---|---|
| | 6-1 | 6-2 | 6-3 | 6-4 | 6-5 | 6-6 | 6-7 | 6-8 |
| $B_2H_6$ flow rate (ppm) (based on $SiH_4$) in forming first lower-part layer | 80 | 90 | 110 | 550 | 2,200 | 2,500 | 2,600 | 2,700 |
| B content (atom ppm) in first lower-part layer | 75 | 80 | 100 | 500 | 2,000 | 2,350 | 2,400 | 2,450 |

Example 7

In the procedure of Example 5-6, negatively-chargeable electrophotographic photosensitive members were produced as Examples 7-1 to 7-7 in the same way except that the flow rate of $B_2H_6$ in forming first lower-part layers was varied to make the first lower-part layers have different content of Group 13 element (boron) based on the total number of atoms of the constituent elements contained therein. These were produced under conditions shown in Tables 16 and 17, and evaluated on the items of negative chargeability, residual potential, insulation breakdown preventability, adherence, potential non-uniformity and overall evaluation in the same way as in Example 1. The results are shown in Table 34.

The flow rates of $B_2H_6$ in forming the first lower-part layers when the negatively-chargeable electrophotographic photosensitive members of Examples 7-1 to 7-7 were produced and the content of Group 13 element (boron) based on the total number of atoms of the constituent elements contained in each first lower-part layer are shown in Table 17. The content of Group 13 element (boron) was measured by SIMS (secondary ion mass spectroscopy) (using IMS-4F, manufactured by Cameca Instruments, Inc.).

TABLE 16

| Gases & gas flow rates | First lower = part layer | Second lower = part layer | Photo-conductive layer | Upper-part layer: Upper = part blocking layer | Upper-part layer: Surface protective layer |
|---|---|---|---|---|---|
| $SiH_4$ [ml/min (normal)] | 100 | 100 | 100 | 90 | 10 |
| $H_2$ [ml/min (normal)] | 600 | 500 | 800 | — | — |
| $B_2H_6$ (ppm) (based on $SiH_4$) | Varied | — | — | — | — |
| $CH_4$ [ml/min (normal)] | — | — | — | 630 | 600 |
| Substrate temp. (° C.) | 260 | 260 | 260 | 260 | 260 |
| Reactor internal pressure (Pa) | 64 | 64 | 79 | 60 | 60 |
| High-frequency power (W) | 100 | 200 | 400 | 300 | 180 |
| Layer thickness (μm) | 10 | 1.5 | 25 | 0.2 | 0.8 |

TABLE 17

| | Example | | | | | | |
|---|---|---|---|---|---|---|---|
| | 7-1 | 7-2 | 7-3 | 7-4 | 7-5 | 7-6 | 7-7 |
| $B_2H_6$ flow rate (ppm) (based on $SiH_4$) in forming first lower-part layer | 7 | 9 | 11 | 21 | 23 | 24 | 26 |

TABLE 17-continued

| | Example | | | | | | |
|---|---|---|---|---|---|---|---|
| | 7-1 | 7-2 | 7-3 | 7-4 | 7-5 | 7-6 | 7-7 |
| B content (atom ppm) in first lower-part layer | 0.7 | 0.8 | 1 | 20 | 23 | 24 | 25 |

Example 8

Negatively-chargeable electrophotographic photosensitive members were produced as Examples 8-1 to 8-8 under conditions shown in Tables 18 to 25, respectively. The negatively-chargeable electrophotographic photosensitive members obtained were each set in the chargeability measuring instrument shown in FIG. 4. Each electrophotographic photosensitive member was provided on its surface with positive electric charges of 2,000 $\mu C/m^2$ by using a positive-charging corona charging assembly as the charging means. Thereafter, this was left to stand for 0.18 second, after which the surface potential of the negatively-chargeable electrophotographic photosensitive member was measured. The values of positive chargeability which were found here are shown in Table 26. These negatively-chargeable electrophotographic photosensitive members were evaluated on the items of negative chargeability, residual potential, insulation breakdown preventability, adherence, potential non-uniformity and overall evaluation in the same way as in Example 1. The results are shown in Table 34.

TABLE 18

| Gases & gas flow rates | First lower = part layer | Second lower = part layer | Photo-conductive layer | Upper-part layer: Upper = part blocking layer | Upper-part layer: Surface protective layer |
|---|---|---|---|---|---|
| $SiH_4$ [ml/min (normal)] | 200 | 100 | 300 | 100 | 30 |
| $H_2$ [ml/min (normal)] | 400 | 400 | 800 | — | — |
| $B_2H_6$ (ppm) (based on $SiH_4$) | 100 | — | — | — | — |
| $CH_4$ [ml/min (normal)] | — | — | — | 700 | 800 |
| Substrate temp. (° C.) | 260 | 260 | 260 | 260 | 260 |
| Reactor internal pressure (Pa) | 64 | 64 | 79 | 60 | 60 |
| High-frequency power (W) | 100 | 200 | 400 | 300 | 180 |
| Layer thickness (μm) | 0.5 | 1.5 | 25 | 0.2 | 1.0 |

TABLE 19

| Gases & gas flow rates | First lower = part layer | Second lower = part layer | Photo-conductive layer | Upper-part layer: Upper = part blocking layer | Upper-part layer: Surface protective layer |
|---|---|---|---|---|---|
| $SiH_4$ [ml/min (normal)] | 100 | 100 | 100 | 90 | 10 |
| $H_2$ [ml/min (normal)] | 600 | 600 | 700 | — | — |
| $B_2H_6$ (ppm) (based on $SiH_4$) | 800 | — | — | — | — |
| NO [ml/min (normal)] | — | 8 | — | — | — |
| $CH_4$ [ml/min (normal)] | — | — | — | 600 | 500 |
| Substrate temp. (° C.) | 260 | 260 | 260 | 260 | 260 |
| Reactor internal pressure (Pa) | 64 | 64 | 79 | 60 | 60 |
| High-frequency power (W) | 100 | 200 | 400 | 300 | 180 |
| Layer thickness (μm) | 1.5 | 1.5 | 25 | 0.2 | 0.8 |

TABLE 20

| Gases & gas flow rates | First lower = part layer | Second lower = part layer | Photo-conductive layer | Upper-part layer: Upper = part blocking layer | Upper-part layer: Surface protective layer |
|---|---|---|---|---|---|
| $SiH_4$ [ml/min (normal)] | 100 | 100 | 100 | 90 | 10 |
| $H_2$ [ml/min (normal)] | 600 | 600 | 700 | — | — |
| $B_2H_6$ (ppm) (based on $SiH_4$) | 800 | — | — | — | — |
| $CH_4$ [ml/min (normal)] | — | 200 | — | 600 | 500 |
| Substrate temp. (° C.) | 260 | 260 | 260 | 260 | 260 |
| Reactor internal pressure (Pa) | 64 | 64 | 79 | 60 | 60 |
| High-frequency power (W) | 100 | 200 | 400 | 300 | 180 |
| Layer thickness (μm) | 1.5 | 1.5 | 25 | 0.2 | 0.8 |

TABLE 21

| Gases & Gas flow rates | First lower = part layer | Second lower = part layer | Photo-conductive layer | Upper-part layer: Upper = part blocking layer | Upper-part layer: Surface protective layer |
|---|---|---|---|---|---|
| $SiH_4$ [ml/min (normal)] | 100 | 100 | 100 | 90 | 10 |
| $H_2$ [ml/min (normal)] | 600 | 500 | 800 | — | — |
| $B_2H_6$ (ppm) (based on $SiH_4$) | 1,000 | — | — | — | — |
| NO [ml/min (normal)] | — | 8 | — | — | — |
| $CH_4$ [ml/min (normal)] | — | 700 | — | 500 | 500 |
| Substrate temp. (° C.) | 260 | 260 | 260 | 260 | 260 |
| Reactor internal pressure (Pa) | 64 | 64 | 79 | 60 | 60 |
| High-frequency power (W) | 100 | 200 | 400 | 200 | 250 |
| Layer thickness (μm) | 1.5 | 1.5 | 25 | 0.2 | 0.8 |

TABLE 22

| Gases & gas flow rates | First lower = part layer | Second lower = part layer | Photo-conductive layer | Upper-part layer: Upper = part blocking layer | Upper-part layer: Surface protective layer |
|---|---|---|---|---|---|
| $SiH_4$ [ml/min (normal)] | 100 | 100 | 100 | 90 | 10 |
| $H_2$ [ml/min (normal)] | 600 | 600 | 700 | — | — |
| $B_2H_6$ (ppm) (based on $SiH_4$) | 1,500 | — | — | — | — |
| $CH_4$ [ml/min (normal)] | — | 800 | — | 600 | 500 |
| Substrate temp. (° C.) | 260 | 260 | 260 | 260 | 260 |
| Reactor internal pressure (Pa) | 64 | 64 | 79 | 60 | 60 |
| High-frequency power (W) | 100 | 200 | 400 | 300 | 180 |
| Layer thickness (μm) | 1.5 | 1.5 | 25 | 0.2 | 0.8 |

TABLE 23

| Gases & gas flow rates | First lower-part layer | Ramping | Second lower-part layer | Photo-conductive layer | Upper-part layer: Upper-part blocking layer | Upper-part layer: Surface protective layer |
|---|---|---|---|---|---|---|
| $SiH_4$ [ml/min (normal)] | 100 | 100 | 100 | 100 | 90 | 50 |
| $H_2$ [ml/min (normal)] | 600 | 600→500 | 500 | 600 | — | — |
| $B_2H_6$ (ppm) (based on $SiH_4$) | 1,000 | 1,000→0 | — | — | — | — |
| NO [ml/min (normal)] | — | 0→8 | 8 | — | — | — |
| $CH_4$ [ml/min (normal)] | — | 0→100 | 100 | — | 630 | 600 |
| Substrate temp. (° C.) | 260 | 260 | 260 | 260 | 260 | 260 |
| Reactor internal pressure (Pa) | 64 | 64 | 64 | 79 | 60 | 60 |
| High-frequency power (W) | 100 | 100→200 | 200 | 400 | 300 | 180 |
| Layer thickness (μm) | 1.5 | 0.2 | 1.5 | 25 | 0.2 | 0.8 |

TABLE 24

| Gases & gas flow rates | First lower = part layer | Second lower = part layer | Photo-conductive layer | Upper-part layer: Upper = part blocking layer | Upper-part layer: Surface protective layer |
|---|---|---|---|---|---|
| $SiH_4$ [ml/min (normal)] | 100 | 100 | 100 | 90 | 10 |
| $H_2$ [ml/min (normal)] | 600 | 500 | 800 | — | — |
| $B_2H_6$ (ppm) (based on $SiH_4$) | 800 | — | — | — | — |
| NO [ml/min (normal)] | — | 8 | — | — | — |
| $CH_4$ [ml/min (normal)] | 100 | 600 | — | 700 | 700 |
| Substrate temp. (° C.) | 260 | 260 | 260 | 260 | 260 |
| Reactor internal pressure (Pa) | 64 | 64 | 79 | 60 | 60 |
| High-frequency power (W) | 100 | 200 | 400 | 200 | 250 |
| Layer thickness (μm) | 1.0 | 1.0 | 28 | 0.5 | 1.0 |

TABLE 25

| Gases & gas flow rates | First lower = part layer | Second lower = part layer | Photo-conductive layer | Upper-part layer: Upper = part blocking layer | Upper-part layer: Surface protective layer |
|---|---|---|---|---|---|
| $SiH_4$ [ml/min (normal)] | 100 | 100 | 100 | 90 | 10 |
| $H_2$ [ml/min (normal)] | 600 | 600 | 700 | — | — |
| $B_2H_6$ (ppm) (based on $SiH_4$) | 500 | — | 5 | — | — |
| $CH_4$ [ml/min (normal)] | — | — | — | 630 | 500 |
| Substrate temp. (° C.) | 260 | 260 | 260 | 260 | 260 |
| Reactor internal pressure (Pa) | 64 | 64 | 79 | 60 | 60 |
| High-frequency power (W) | 100 | 200 | 400 | 300 | 180 |
| Layer thickness (μm) | 1.5 | 1.5 | 25 | 0.2 | 0.8 |

TABLE 26

| | Example 8-1 | 8-2 | 8-3 | 8-4 | 8-5 | 8-6 | 8-7 | 8-8 |
|---|---|---|---|---|---|---|---|---|
| Positive chargeability (V) | 4 | 5 | 30 | 40 | 50 | 100 | 110 | 115 |

Example 9

In the procedure of Example 8-4, a negatively-chargeable electrophotographic photosensitive member was produced under conditions shown in Table 27, in the same way except that the flow rate of $CH_4$ in forming the upper-part layer as a layer containing silicon atoms and carbon atoms was changed to form it as a layer having a region where the compositional ratio of carbon atoms to silicon atoms constituting the upper-part layer increased toward the surface side (free-surface side) of the electrophotographic photosensitive member. This electrophotographic photosensitive member was evaluated on the items of negative chargeability, residual potential, insulation breakdown preventability, adherence, potential non-uniformity and overall evaluation in the same way as in Example 1. The results are shown in Table 34.

TABLE 27

| Gases & gas flow rates | First lower = part layer | Second lower = part layer | Photo-conductive layer | Upper-part layer: Upper = part blocking layer | Upper-part layer: Surface protective layer |
|---|---|---|---|---|---|
| $SiH_4$ [ml/min (normal)] | 100 | 100 | 100 | 100→60 | 60→10 |
| $H_2$ [ml/min (normal)] | 600 | 500 | 800 | — | — |

TABLE 27-continued

| Gases & gas flow rates | First lower = part layer | Second lower = part layer | Photo-conductive layer | Upper-part layer: Upper = part blocking layer | Upper-part layer: Surface protective layer |
|---|---|---|---|---|---|
| $B_2H_6$ (ppm) (based on $SiH_4$) | 1,000 | — | — | — | — |
| NO [ml/min (normal)] | — | 8 | — | — | — |
| $CH_4$ [ml/min (normal)] | — | 700 | — | 0→800 | 800→1,000 |
| Substrate temp. (° C.) | 260 | 260 | 260 | 260 | 260 |
| Reactor internal pressure (Pa) | 64 | 64 | 79 | 60 | 60 |
| High-frequency power (W) | 100 | 200 | 400 | 400→180 | |
| Layer thickness (μm) | 1.5 | 1.5 | 25 | 0.3 | 1.0 |

Example 10

In the procedure of Example 8-4, six kinds of negatively-chargeable electrophotographic photosensitive members were produced as Examples 10-1 to 10-6 under conditions shown in Tables 28 and 29, in the same way except that the first lower-part layer containing silicon atoms and carbon atoms was formed in a double-layer structure having i) a first lower-part layer having a region containing a Group 13 element and ii) a second lower-part layer and the flow rate of $B_2H_6$ in forming upper-part blocking layers was varied to make the upper-part blocking layers have different content of Group 13 element (boron) based on the total number of atoms of the constituent elements contained therein. These were evaluated on the items of negative chargeability, residual potential, insulation breakdown preventability, adherence, potential non-uniformity and overall evaluation in the same way as in Example 1. The results are shown in Table 34.

The flow rates of $B_2H_6$ in forming the upper-part blocking layers when the negatively-chargeable electrophotographic photosensitive members of Examples 10-1 to 10-6 were produced and the content of Group 13 element (boron) based on the total number of atoms of the constituent elements contained in each upper-part blocking layer are shown in Table 29. The content of Group 13 element (boron) was measured by SIMS (secondary ion mass spectroscopy) (using IMS-4F, manufactured by Cameca Instruments, Inc.).

TABLE 28

| Gases & gas flow rates | First lower = part layer | Second lower = part layer | Photo-conductive layer | Upper-part layer: Upper = part blocking layer | Upper-part layer: Surface protective layer |
|---|---|---|---|---|---|
| $SiH_4$ [ml/min (normal)] | 100 | 100 | 100 | 90 | 10 |
| $H_2$ [ml/min (normal)] | 600 | 500 | 800 | — | — |
| $B_2H_6$ (ppm) (based on $SiH_4$) | 1,000 | — | — | Varied | — |
| NO [ml/min (normal)] | — | 8 | — | — | — |
| $CH_4$ [ml/min (normal)] | — | 700 | — | 90 | 600 |
| Substrate temp. (° C.) | 260 | 260 | 260 | 260 | 260 |
| Reactor internal pressure (Pa) | 64 | 64 | 79 | 60 | 60 |
| High-frequency power (W) | 100 | 200 | 400 | 300 | 180 |
| Layer thickness (μm) | 1.5 | 1.5 | 25 | 0.2 | 0.8 |

TABLE 29

| | Example 10-1 | 10-2 | 10-3 | 10-4 | 10-5 | 10-6 |
|---|---|---|---|---|---|---|
| $B_2H_6$ flow rate (ppm) (based on $SiH_4$) in forming upper-part blocking layer | 100 | 110 | 2,200 | 21,000 | 31,000 | 32,000 |
| B content (atom ppm) in upper-part blocking layer | 90 | 100 | 2,000 | 20,000 | 29,500 | 30,100 |

Example 11

In the procedure of Example 9, a negatively-chargeable electrophotographic photosensitive member was produced under conditions shown in Table 30, in the same way except that the upper-part layer was formed as a layer having a region containing a Group 13 element. This electrophotographic photosensitive member was evaluated on the items of negative chargeability, residual potential, insulation breakdown preventability, adherence, potential non-uniformity and over-all evaluation in the same way as in Example 1. The results are shown in Table 34.

TABLE 30

| Gases & gas flow rates | Upper-part layer | | |
|---|---|---|---|
| | | Upper-part blocking layer | Surface protective layer |
| $SiH_4$ [ml/min(normal)] | 100→90 | 90→70 | 70→10 |
| $H_2$ [ml/min(normal)] | 800→100 | 100→0 | — |
| $B_2H_6$ (ppm) (based on $SiH_4$) | — | 300 | — |
| $CH_4$ [ml/min(normal)] | 0→100 | 100→150 | 150→800 |
| Substrate temp. (° C.) | 260 | 260 | 260 |
| Reactor internal pressure (Pa) | 60 | 60 | 60 |
| High-frequency power (W) | 400→300 | 300→200 | 200→180 |
| Layer thickness (μm) | 0.3 | 0.3 | 0.8 |

Comparative Example 1

In the procedure of Example 10, a negatively-chargeable electrophotographic photosensitive member was produced under conditions shown in Table 31, in the same way except that the first lower-part layer was not formed. This electrophotographic photosensitive member was evaluated on the items of negative chargeability, residual potential, insulation breakdown preventability, adherence and potential non-uniformity in the same way as in Example 1. The results are shown in Table 34.

TABLE 31

| Gases & gas flow rates | Lower-part layer | Photo-conductive layer | Upper-part layer | |
|---|---|---|---|---|
| | | | Upper = part blocking layer | Surface protective layer |
| $SiH_4$ [ml/min(normal)] | 100 | 100 | 90 | 10 |
| $H_2$ [ml/min(normal)] | 500 | 800 | — | — |
| $B_2H_6$ (ppm) (based on $SiH_4$) | — | — | 300 | — |
| NO [ml/min(normal)] | 8 | — | — | — |
| $CH_4$ [ml/min(normal)] | 700 | — | 90 | 600 |
| Substrate temp. (° C.) | 260 | 260 | 260 | 260 |
| Reactor internal pressure (Pa) | 64 | 79 | 60 | 60 |
| High-frequency power (W) | 200 | 400 | 300 | 180 |
| Layer thickness (μm) | 1.5 | 25 | 0.2 | 0.8 |

Comparative Example 2

In the procedure of Comparative Example 1, negatively-chargeable electrophotographic photosensitive members were produced as Comparative Examples 2-1 to 2-4 under conditions shown in Table 32, in the same way except that the flow rate of $CH_4$ in forming lower-part layers was varied to make the lower-part layers have different dark conductivity. These were evaluated on the items of negative chargeability, residual potential, insulation breakdown preventability, adherence and potential non-uniformity in the same way as in Example 1. The results are shown in Table 34.

Here, the dark conductivity of the lower-part layer used in the negatively-chargeable electrophotographic photosensitive members obtained as Comparative Examples 2-1 to 2-4 was measured in the same way as in Example 3. The results are shown in Table 33 together with the flow rates of $CH_4$ in forming the lower-part layers when the negatively-chargeable electrophotographic photosensitive members of Comparative Examples 2-1 to 2-4 were produced.

TABLE 32

| Gases & gas flow rates | Lower-part layer | Photo-conductive layer | Upper-part layer | |
|---|---|---|---|---|
| | | | Upper = part blocking layer | Surface protective layer |
| $SiH_4$ [ml/min(normal)] | 100 | 100 | 90 | 10 |
| $H_2$ [ml/min(normal)] | 500 | 800 | — | — |
| $B_2H_6$ (ppm) (based on $SiH_4$) | — | — | 300 | — |
| NO [ml/min(normal)] | 8 | — | — | — |
| $CH_4$ [ml/min(normal)] | Varied | — | 90 | 600 |
| Substrate temp. (° C.) | 260 | 260 | 260 | 260 |
| Reactor internal pressure (Pa) | 64 | 79 | 60 | 60 |
| High-frequency power (W) | 200 | 400 | 300 | 180 |
| Layer thickness (μm) | 1.5 | 25 | 0.2 | 0.8 |

TABLE 33

| | Comparative Example | | | |
|---|---|---|---|---|
| | 2-1 | 2-2 | 2-3 | 2-4 |
| $CH_4$ flow rate [ml/min(normal)] in forming lower-part layer | 300 | 600 | 900 | 1,100 |
| Dark conductivity (S/m) | $1.09 \times 10^{-10}$ | $9.89 \times 10^{-13}$ | $2.56 \times 10^{-14}$ | $1.07 \times 10^{-15}$ |

TABLE 34

| | | Negative chargeability | Residual potential | Insulation break-down preventability | Adherence | Potential non-uniformity | Over-all evaluation |
|---|---|---|---|---|---|---|---|
| Example 1 | | A | A | A | A | A | A |
| Ex. 2 | 2-1 | AA | A | A | A | A | A |
| | 2-2 | AA | A | A | A | A | A |

TABLE 34-continued

| | | Negative chargeability | Residual potential | Insulation break-down preventability | Adherence | Potential non-uniformity | Over-all evaluation |
|---|---|---|---|---|---|---|---|
| Ex. 3 | 3-1 | AA | A | A | A | A | A |
| | 3-2~3-4 | AA | A | AA | A | A | AA |
| | 3-5 | AA | B | AA | A | A | B |
| Ex. 4 | 4-1 | AA | A | AA | A | A | AA |
| | 4-2 | AA | A | AA | A | A | AA |
| | 4-3 | AA | A | AA | A | A | AA |
| Ex. 5 | 5-1 | A | A | A | A | B | B |
| | 5-2~5-6 | A | A | A | A | A | A |
| | 5-7 | A | A | A | B | A | B |
| Ex. 6 | 6-1 | A | A | A | A | A | A |
| | 6-2~6-7 | A | A | AA | A | A | AA |
| | 6-8 | A | B | AA | A | A | B |
| Ex. 7 | 7-1 | A | A | A | A | A | A |
| | 7-2~7-6 | A | A | AA | A | A | AA |
| | 7-7 | A | B | AA | A | A | B |
| Ex. 8 | 8-1 | A | A | A | A | A | A |
| | 8-2 & 8-3 | AA | A | AA | A | A | AA |
| | 8-4~8-7 | AA | A | AAA | A | A | AAA |
| | 8-8 | A | B | AAA | A | A | B |
| Example 9 | | AA | A | AAA | A | AA | AAA |
| Ex. 10 | 10-1 | AA | A | AAA | A | A | AAA |
| | 10-2~10-5 | AAA | A | AAA | A | A | AAA |
| | 10-6 | AA | A | AAA | A | A | AAA |
| Example 11 | | AAA | A | AAA | A | AA | AAA |
| Comp. Ex. 1 | | AAA | A | C | A | A | C |
| Cp. 2 | 2-1 & 2-2 | AAA | A | C | A | A | C |
| | 2-3 & 2-4 | AAA | C | B | A | A | C |

Ex.: Example;
Cp.: Comparative Example

As is evident from the results shown in Table 34, in Comparative Example 1, because of a method in which the first lower-part layer for preventing the insulation breakdown that may occur because the electric field with a polarity reverse to the charging polarity is applied to the electrophotographic photosensitive member, the electrophotographic photosensitive member resulted in a low insulation breakdown preventability.

In Examples 2-1 and 2-2, it is ascertained that forming the second lower-part layer as the layer containing a Group 15 element enhances the ability to block the holes coming into it from the substrate side, to bring an improvement in negative chargeability.

As is also ascertained in Examples 3-1 to 3-5, the feature that the second lower-part layer has a dark conductivity of from $1.0\times10^{-14}$ S/m or more to $1.0\times10^{-9}$ S/m or less is preferable in view of negative chargeability, residual potential and insulation breakdown preventability. This is presumed to be due to enhancement of the ability to block the holes coming into it from the substrate side and enhancement of the ability to block at the second lower-part layer the electrons coming into it from the substrate side without being completely blocked at the first lower-part layer when the electric field with a polarity reverse to the charging polarity is applied to the electrophotographic photosensitive member, during usual processing.

As is still also ascertained in Examples 4-1 to 4-3, forming the second lower-part layer as the layer containing at least one kind among carbon atoms and oxygen atoms and containing silicon atoms brings improvements in negative chargeability and insulation breakdown preventability.

As is seen from Examples 5-1 to 5-7, Examples 6-1 to 6-8 and Examples 7-1 to 7-7, the layer thickness of the first lower-part layer may be in the range of from 0.1 μm to 10 μm, and this is preferable in view of adherence and potential non-uniformity and further the product of i) the content (atom ppm) of the Group 13 element, based on the total number of atoms of constituent elements contained in the first lower-part layer and ii) the layer thickness of the first lower-part layer may be from 8 atom ppm·μm or more to 240 atom ppm·μm or less, and this is much preferable in view of residual potential and insulation breakdown preventability.

As is also seen from Examples 8-1 to 8-8, the negatively-chargeable electrophotographic photosensitive member may have surface potential in the range of from 5 V or more to 110 V or less after it is provided on its surface with positive electric charges of 2,000 $\mu C/m^2$ and thereafter has been left to stand for 0.18 second, and this is preferable in view of residual potential and insulation breakdown preventability. The above surface potential may also be in the range of from 40 V or more to 110 V or less, and this is much preferable in view of residual potential and insulation breakdown preventability.

As is still also seen from Examples 9 and 11, making up the upper-part layer to have a region where the compositional ratio of carbon atoms to silicon atoms which constitute the upper-part layer increases toward the surface side (free-surface side) of the electrophotographic photosensitive member brings an improvement in potential non-uniformity.

In Examples 10-1 to 10-6, it is also ascertained that making the upper-part layer have a region having a Group 13 element in a content of from 100 atom ppm or more to 30,000 atom ppm or less based on the total number of atoms of constituent elements constituting the upper-part layer brings an improvement in negative chargeability.

In Comparative Examples 2-1 to 2-4, in the lower-part layer single-layer structure that is of conventional layer configuration, any range can not been found out in which both the controlling of residual potential and the insulation breakdown preventability are achievable.

Example 12

The negatively-chargeable electrophotographic photosensitive member produced by the procedure of Example 11 was set in the electrophotographic apparatus shown in FIG. 7, which carries out the image forming process having a charging step, a latent image forming step, a developing step, a transfer step and a cleaning step. Images were formed by using as the latent image forming step the background exposure method (BAE method). The images thus obtained were those at a level of no problem in practical use.

Example 13

In the procedure of Example 12, the negatively-chargeable electrophotographic photosensitive member was set in the electrophotographic apparatus shown in FIG. 7, to form images in the same way except that the latent image forming step was so changed in its imagewise exposure system that the latent images were formable by the imagewise exposure method (IAE method). The images thus obtained were evaluated on their resolution in the following way. The results are shown in Table 36.

Resolution:

A test chart in which 1-point size and 2-point size alphabets (A to Z) and complicate Chinese characters (電 and 驚)were arranged in a resolution of 2,400 dpi was prepared on a personal computer. Thereafter, images obtained by printing the test chart were used to make evaluation of their resolution attributable to the photosensitive member. Stated specifically, the images reproduced were read by using a scanner (CanoScan 8600F (trade name), manufactured by CANON INC.). Image data thus read were compared with original data of the test chart to calculate the area percentage of portions deviated from letters and characters of the test original (thick line images or slim line images). The resolution attributable to the photosensitive member was evaluated by the numerical values (%) found. Results obtained were ranked by relative evaluation made assuming the value on the images obtained in Example 12 as reference, i.e., 100%.

A: The electrophotographic photosensitive member causes no insulation breakdown and gives a value of less than 80%, being at a very good level.

B: The electrophotographic photosensitive member causes no insulation breakdown and gives a value of from 80% or more to less than 95%, being at a good level.

C: The electrophotographic photosensitive member causes no insulation breakdown and gives a value of from 95% or more to less than 105%, being substantially at the same level as the reference.

D: The electrophotographic photosensitive member stands to bring about insulation breakdown or gives a value of 105% or more, but being at a level of no problem in practical use.

Example 14

In the procedure of Example 13, the negatively-chargeable electrophotographic photosensitive member was set in the electrophotographic apparatus shown in FIG. 7, to form images in the same way except that the charging step was changed for a step making use of the contact charging means having magnetic particles which are provided in contact with the negatively-chargeable electrophotographic photosensitive member and a developing means used in the developing step was changed for the two-component developing means having the two-component developer containing a toner and magnetic particles. The images thus obtained were evaluated on their resolution in the same way as in Example 13. The results are shown in Table 36.

Example 15

In the procedure of Example 14, the condition for two-component development bias, |Vpp|/2−|Vdc|, in the developing step was changed as shown in Table 35, and images corresponding respectively to the conditions changed were obtained as Examples 15-1 to 15-6. The images thus obtained were evaluated on their resolution in the same way as in Example 13. The results are shown in Table 36.

TABLE 35

| | Example | | | | | |
|---|---|---|---|---|---|---|
| | 15-1 | 15-2 | 15-3 | 15-4 | 15-5 | 15-6 |
| Two-component development bias condition \|Vpp\|/2 − \|Vdc\| | 140 | 150 | 160 | 1,400 | 1,500 | 1,600 |

Comparative Example 3

In the procedure of Example 15, the negatively-chargeable electrophotographic photosensitive member set in the electrophotographic apparatus was changed for the negatively-chargeable electrophotographic photosensitive member produced in Comparative Example 1, and images were formed in the same way. The images thus obtained were evaluated on their resolution in the same way as in Example 13. The results are shown in Table 36.

TABLE 36

| | Example | | | Example 15 | | | Comparative |
|---|---|---|---|---|---|---|---|
| | 12 | 13 | 14 | 15-1 | 15-2~15-5 | 15-6 | Example 3 |
| Resolution | C | B | A | B | A | B | D |

As is evident from Table 36, in Comparative Example 3, the electrophotographic photosensitive member of Comparative Example 1 is used in which the first lower-part layer is not formed, which is to prevent the insulation breakdown that may occur because the electric field with a polarity reverse to the charging polarity is applied to the electrophotographic photosensitive member, and hence the electrophotographic photosensitive member has bought about insulation breakdown, resulting in occurrence of faulty images. It is also seen from Example 13 that the use of the imagewise exposure method (IAE method) as the latent image forming step brings an improvement in resolution. It is still also seen from Example 14 that changing the charging means in the charging step for the contact charging means having magnetic particles which are provided in contact with the electrophotographic photosensitive member and changing the developing means in the developing step for the two-component developing means having the two-component developer containing a toner and magnetic particles, to form images bring a further improvement in resolution. It is still also seen from Examples 15-1 to 15-6 that setting the condition for two-component development bias, |Vpp|/2−|Vdc|, in the developing step in such a way as to be in the range of 150 V≦|Vpp|/2−|Vdc|≦1,500 V to form images is preferable from the viewpoint of resolution.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2008-133042, filed on May 21, 2008, which is herein incorporated by reference as part of this application.

What is claimed is:

1. A negatively-chargeable electrophotographic photosensitive member comprising:

a cylindrical substrate having a conductive surface, and a photoconductive layer formed of a non-single crystal material containing silicon atoms, wherein a first lower-part layer formed of a non-single crystal material containing silicon atoms and a second lower-part layer formed of a non-single crystal material containing silicon atoms are provided between the cylindrical substrate and the photoconductive layer, an upper-part layer formed of a non-single crystal material containing silicon atoms is provided on the photoconductive layer, the first lower-part layer is a layer containing an element belonging to Group 13 of the periodic table, the upper-part layer has a region capable of retaining electrification charges, and the first lower-part layer has a layer thickness of from 0.1 μm or more to 10 μm or less, and the product of i) the content, in atom ppm, of the Group 13 element, based on the total number of atoms of constituent elements contained in the first lower-part layer and ii) the layer thickness of the first lower-part layer is from 8 atom ppm·μm or more to 240 atom ppm·μm or less.

2. The negatively-chargeable electrophotographic photosensitive member according to claim 1, wherein the second lower-part layer is a layer containing an element belonging to Group 15 of the periodic table.

3. The negatively-chargeable electrophotographic photosensitive member according to claim 1, wherein the second lower-part layer has a dark conductivity of from $1.0\times10^{-14}$ S/m or more to $1.0\times10^{-9}$ S/m or less.

4. The negatively-chargeable electrophotographic photosensitive member according to claim 1, wherein the second lower-part layer is a layer containing atoms selected from the group consisting of carbon atoms and oxygen atoms.

5. The negatively-chargeable electrophotographic photosensitive member according to claim 1, which is to have surface potential in the range of from 5 V or more to 110 V or less after the negatively-chargeable electrophotographic photosensitive member is provided on its surface with positive electric charges of 2,000 $\mu C/m^2$ by using a corona charging assembly and thereafter has been left to stand for 0.18 second.

6. The negatively-chargeable electrophotographic photosensitive member according to claim 5, which is to have surface potential in the range of from 40 V or more to 110 V or less after the negatively-chargeable electrophotographic photosensitive member is provided on its surface with positive electric charges of 2,000 $\mu C/m^2$ by using a corona charging assembly and thereafter has been left to stand for 0.18 second.

7. The negatively-chargeable electrophotographic photosensitive member according to claim 1, wherein the upper-part layer contains silicon atoms and carbon atoms and has a region where the compositional ratio of carbon atoms to silicon atoms contained in the upper-part layer increases toward the surface side of the negatively-chargeable electrophotographic photosensitive member.

8. The negatively-chargeable electrophotographic photosensitive member according to claim 1, wherein the upper-part layer has a region containing the periodic-table Group 13 element in an amount of from 100 atom ppm or more to 30,000 atom ppm or less based on the total number of atoms of constituent elements constituting the upper-part layer.

9. An electrophotographic apparatus comprising:

charging means for charging a surface of a negatively-chargeable electrophotographic photosensitive member electrostatically;

latent image forming means for forming an electrostatic latent image on the surface of the negatively-chargeable electrophotographic photosensitive member, thus charged;

developing means for moving a toner held on a developer carrying member, to the surface of the negatively-chargeable electrophotographic photosensitive member to develop the electrostatic latent image to form a toner image on the surface of the same;

transfer means for transferring the toner image from the surface of the negatively-chargeable electrophotographic photosensitive member to a transfer material; and cleaning means for removing from the negatively-chargeable electrophotographic photosensitive member a transfer residual toner having remained on the surface of the negatively-chargeable electrophotographic photosensitive member; wherein;

the negatively-chargeable electrophotographic photosensitive member comprises:

a cylindrical substrate having a conductive surface, and a photoconductive layer formed of a non-single crystal material containing silicon atoms, wherein a first lower-part layer formed of a non-single crystal material containing silicon atoms and a second lower-part layer formed of a non-single crystal material containing silicon atoms are provided between the cylindrical substrate and the photoconductive layer, an upper-part layer formed of a non-single crystal material containing silicon atoms is provided on the photoconductive layer, the first lower-part layer is a layer containing an element belonging to Group 13 of the periodic table, the upper-part layer has a region capable of retaining electrification charges, and the first lower-part layer has a layer thickness of from 0.1 μm or more to 10 μm or less, and the product of i) the content, in atom ppm, of the Group 13 element, based on the total number of atoms of constituent elements contained in the first lower-part layer and ii) the layer thickness of the first lower-part layer is from 8 atom ppm·μm or more to 240 atom ppm·μm or less.

10. The electrophotographic apparatus according to claim 9, wherein the latent image forming means forms the electrostatic latent image by an imagewise exposure method.

11. The electrophotographic apparatus according to claim 9, wherein the charging means is a contact charging means comprising magnetic particles which are provided in contact with the negatively-chargeable electrophotographic photosensitive member, and the developing means is a two-component developing means comprising a developer carrying member and a two-component development type developer containing a toner and magnetic particles.

* * * * *